US010907906B2

(12) United States Patent
Sun et al.

(10) Patent No.: US 10,907,906 B2
(45) Date of Patent: Feb. 2, 2021

(54) PLATE HEAT EXCHANGER AND HEAT PUMP HEATING AND HOT WATER SUPPLY SYSTEM INCLUDING THE PLATE HEAT EXCHANGER

(71) Applicant: Mitsubishi Electric Corporation, Chiyoda-ku (JP)

(72) Inventors: Faming Sun, Chiyoda-ku (JP); Susumu Yoshimura, Chiyoda-ku (JP); Norihiro Yoneda, Chiyoda-ku (JP); Takashi Matsumoto, Chiyoda-ku (JP); Daisuke Ito, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 232 days.

(21) Appl. No.: 16/066,744

(22) PCT Filed: Jan. 19, 2017

(86) PCT No.: PCT/JP2017/001808
§ 371 (c)(1),
(2) Date: Jun. 28, 2018

(87) PCT Pub. No.: WO2017/138322
PCT Pub. Date: Aug. 17, 2017

(65) Prior Publication Data

US 2019/0017748 A1 Jan. 17, 2019

(30) Foreign Application Priority Data

Feb. 12, 2016 (JP) ..... 2016-024704

(51) Int. Cl.
*F28D 9/02* (2006.01)
*F28F 3/06* (2006.01)
(Continued)

(52) U.S. Cl.
CPC ..... *F28D 9/02* (2013.01); *F28D 9/005* (2013.01); *F28F 3/02* (2013.01); *F28F 3/022* (2013.01);
(Continued)

(58) Field of Classification Search
CPC .... F28D 9/02; F28D 9/005; F28F 3/02; F28F 3/022; F28F 3/027; F28F 3/044;
(Continued)

(56) References Cited

U.S. PATENT DOCUMENTS 2,777,674 A * 1/1957 Wakeman ..... F28F 3/046 165/167
3,460,611 A * 8/1969 Tramuta ..... F28D 9/0037 165/166
(Continued)

FOREIGN PATENT DOCUMENTS

CN 202792543 U 3/2013
EP 2998676 A1 * 3/2016 ..... F25B 40/02
(Continued)

OTHER PUBLICATIONS

Extended European Search Report dated Oct. 31, 2018 in Patent Application No. 17750047.7, 8 pages.
(Continued)

*Primary Examiner* — Tho V Duong
(74) *Attorney, Agent, or Firm* — Xsensus LLP

(57) ABSTRACT

In a plate heat exchanger, a bypass passage and a main passage are formed upstream of first passages and second passages between adjacent ones of first heat transfer plates and second heat transfer plates. The bypass passage allows first fluid flowing from an inflow port of the first fluid or second fluid flowing from an inflow port of the second fluid to pass a side farther than a corresponding one of adjacent holes while spreading in a vertical direction in a front view
(Continued)

and then flow into an inner fin or a corrugated heat transfer surface. The main passage allows the first fluid flowing from the inflow port of the first fluid or the second fluid flowing from the inflow port of the second fluid to directly flow toward the inner fin or the corrugated heat transfer surface without routing through the bypass passage. A flat space is formed around an entire circumference of each of the adjacent holes, between a circumferential wall and the inner fin or the corrugated heat transfer surface.

19 Claims, 14 Drawing Sheets

(51) Int. Cl.
*F28F 3/02* (2006.01)
*F28D 9/00* (2006.01)
*F28F 3/04* (2006.01)

(52) U.S. Cl.
CPC ..... *F28F 3/027* (2013.01); *F28F 3/044* (2013.01); *F28F 3/046* (2013.01); *F28F 3/048* (2013.01); *F28F 3/06* (2013.01); *F28F 3/025* (2013.01); *F28F 2225/04* (2013.01); *F28F 2240/00* (2013.01)

(58) Field of Classification Search
CPC .... F28F 3/046; F28F 3/048; F28F 3/06; F28F 3/086; F28F 3/025; F28F 2240/00; F28F 2225/04
See application file for complete search history.

(56) References Cited

U.S. PATENT DOCUMENTS 4,781,248 A 11/1988 Pfeiffer
6,298,910 B1 * 10/2001 Komoda ..... B23K 1/0012 165/133
6,843,311 B2 * 1/2005 Evans ..... F28D 9/005 165/109.1
2001/0030043 A1 * 10/2001 Gleisle ..... F28F 3/10 165/167
2001/0054501 A1 12/2001 Wehrmann et al.
2002/0066552 A1 6/2002 Komoda
2003/0201094 A1 10/2003 Evans et al.
2006/0237184 A1 * 10/2006 Peric ..... F28F 27/02 165/283
2007/0130990 A1 * 6/2007 Bellemo ..... B01D 5/0015 62/515
2011/0024096 A1 * 2/2011 Christensen ..... F28F 3/046 165/166
2011/0083833 A1 4/2011 Zorzin et al.
2011/0088882 A1 * 4/2011 Persson ..... F28D 9/005 165/167

FOREIGN PATENT DOCUMENTS

JP 63-25494 A 2/1988
JP 01033497 A * 2/1989
JP 2002-022374 A 1/2002
JP 2002-168591 A 6/2002
JP 2005-524042 A 8/2005
JP 2007-205634 A 8/2007
JP 2012-002425 A 1/2012
WO WO 2008/023732 A1 2/2008

OTHER PUBLICATIONS

Chinese Office Action dated Jan. 6, 2020 in Chinese Patent Application No. 201780009715.5 (with English translation), 19 pages.
Office Action dated Jun. 21, 2019 in corresponding European Patent Application No. 17 750 047.7, 4 pages.
Combined Chinese Office Action and Search Report dated Jun. 26, 2019 in corresponding Chinese Patent Application No. 201780009715.5 (with English Translation and English Translation of Category of Cited Documents), 18 pages.
International Search Report dated Mar. 7, 2017 in PCT/JP2017/001808, filed on Jan. 19, 2017.
Office Action dated Apr. 16, 2019 in corresponding Japanese Patent Application No. 2017-566566 (with English Translation), 9 pages.

* cited by examiner

EXAMPLE 1 EXAMPLE 2

PLATE HEAT EXCHANGER AND HEAT PUMP HEATING AND HOT WATER SUPPLY SYSTEM INCLUDING THE PLATE HEAT EXCHANGER

TECHNICAL FIELD

The present invention relates to an inner fin plate heat exchanger having a plurality of alternately stacked layers of heat transfer plates and inner fins and a heat pump heating and hot water supply system including the plate heat exchanger.

BACKGROUND ART

Existing heat exchangers include a plate heat exchanger having a plurality of alternately stacked layers of quadrangular metal plates having four corners provided with passage holes forming inflow and outflow ports of fluid and corrugated metal inner fins having an outer shape substantially the same as the outer shape of the metal plates (see Patent Literature 1, for example).

The plate heat exchanger described in Patent Literature 1 enables ensured pressure resisting strength, a simplified and downsized container structure, and a simplified manufacturing process, and improves an internal flow of fluid through designing of a direct flow and adjustment of a fin arrangement direction to obtain sufficient thermal efficiency.

CITATION LIST

Patent Literature

Patent Literature 1: International Publication No. 2008/023732

SUMMARY OF INVENTION

Technical Problem

According to the existing plate heat exchanger described in Patent Literature 1, however, the fluid has difficulty in evenly flowing through the heat exchanger unless the inner fins have high flow resistance, thereby raising an issue of pressure loss. Further, header portions of the heat exchanger do not account for an effective heat transfer area, therefore raising an issue of heat transfer performance. Further, the header portions include many components, raising a cost issue.

The present invention has been made to address issues such as those described above, and aims to provide a plate heat exchanger enabling a reduction in cost while reducing the pressure loss and improving the heat transfer performance to improve heat exchange performance and a heat pump heating and hot water supply system including the plate heat exchanger.

Solution to Problem

A plate heat exchanger according to an embodiment of the present invention includes first heat transfer plates and second heat transfer plates. Each of the first heat transfer plates has a rectangular plate shape, and has a passage hole formed in one side portion thereof in a horizontal direction in a front view thereof to form an inflow port of first fluid, a passage hole formed in an other side portion thereof in the horizontal direction in the front view to form an outflow port of the first fluid, an adjacent hole formed in the one side portion or the other side portion to form an inflow port of second fluid, and an adjacent hole formed in the side portion opposite to the side portion formed with the adjacent hole for the second fluid to form an outflow port of the second fluid. Each of the second heat transfer plates has a rectangular plate shape, and has an adjacent hole formed in one side portion thereof in a horizontal direction in a front view thereof to form the inflow port of the first fluid, an adjacent hole formed in an other side portion thereof in the horizontal direction in the front view to form the outflow port of the first fluid, a passage hole formed in the one side portion or the other side portion to form the inflow port of the second fluid, and a passage hole formed in the side portion opposite to the side portion formed with the passage hole for the second fluid to form the outflow port of the second fluid. The first heat transfer plates and the second heat transfer plates are alternately stacked in a plurality of layers to alternately form first passages and second passages in a stacking direction between the first heat transfer plates and the second heat transfer plates. The first passages allow the first fluid to flow therethrough from the inflow port of the first fluid to the outflow port of the first fluid in the horizontal direction in the front view, and the second passages allow the second fluid to flow therethrough from the inflow port of the second fluid to the outflow port of the second fluid in the horizontal direction in the front view, to exchange heat between the first fluid flowing through the first passages and the second fluid flowing through the second passages.

Each of the first heat transfer plates and a corresponding one of the second heat transfer plates have an inner fin therebetween, or each of the first heat transfer plates and the second heat transfer plates has a corrugated heat transfer surface. Each of the adjacent holes is provided with a circumferential wall in a thickness direction around a circumferential edge thereof, and the circumferential wall is provided with a flange on a front surface side thereof. The flange provided to each of the first heat transfer plates and the second heat transfer plates is joined to a rear surface of one of the first heat transfer plates and the second heat transfer plates adjacent to each of the first heat transfer plates and the second heat transfer plates. A bypass passage and a main passage are formed upstream of the first passages and the second passages between adjacent ones of the first heat transfer plates and the second heat transfer plates. The bypass passage allows the first fluid flowing from the inflow port of the first fluid or the second fluid flowing from the inflow port of the second fluid to pass a side farther than a corresponding one of the adjacent holes while spreading in a vertical direction in the front view and then flow into the inner fin or the corrugated heat transfer surface. The main passage allows the first fluid flowing from the inflow port of the first fluid or the second fluid flowing from the inflow port of the second fluid to directly flow toward the inner fin or the corrugated heat transfer surface without routing through the bypass passage. A flat space is formed around an entire circumference of each of the adjacent holes, and the first fluid or the second fluid flowing through the main passage and the first fluid or the second fluid flowing through the bypass passage merge in the space between the circumferential wall and the inner fin or the corrugated heat transfer surface.

Advantageous Effects of Invention

The plate heat exchanger according to the embodiment of the present invention is formed with the bypass passage allowing the first fluid flowing from the inflow port of the first fluid or the second fluid flowing from the inflow port of the second fluid to flow in the vertical direction, and the first fluid and the second fluid flow in the horizontal direction while spreading in the vertical direction. It is therefore possible to improve in-plane distribution uniformity of the first heat transfer plates and the second heat transfer plates, increase the heat transfer area of the header portions, and prevent the occurrence of stagnation of an in-plane flow. Further, with the bypass passage, the cross sections of the passages near in-plane inflow and outflow ports of the heat transfer plates are increased, thereby enabling a reduction in overall pressure loss. Further, the plate heat exchanger is simplified in structure, enabling a reduction in cost.

DESCRIPTION OF EMBODIMENTS

Embodiments 1 to 12 of the present invention will be described below based on the drawings. The present invention is not limited by Embodiments 1 to 12 described below. Further, in the following drawings, the dimensional relationships between component members may be different from actual ones.

In the following description, terms denoting directions (such as "upper," "lower," "right," and "left," for example) will be used as appropriate to facilitate understanding. However, these terms are for illustrative purposes, and do not limit the invention of the present application. Further, in Embodiments 1 to 12 of the present invention, the terms "upper," "lower," "right," and "left" will be used in a front view of a plate heat exchanger 100.

Embodiment 1

Figure 1A:
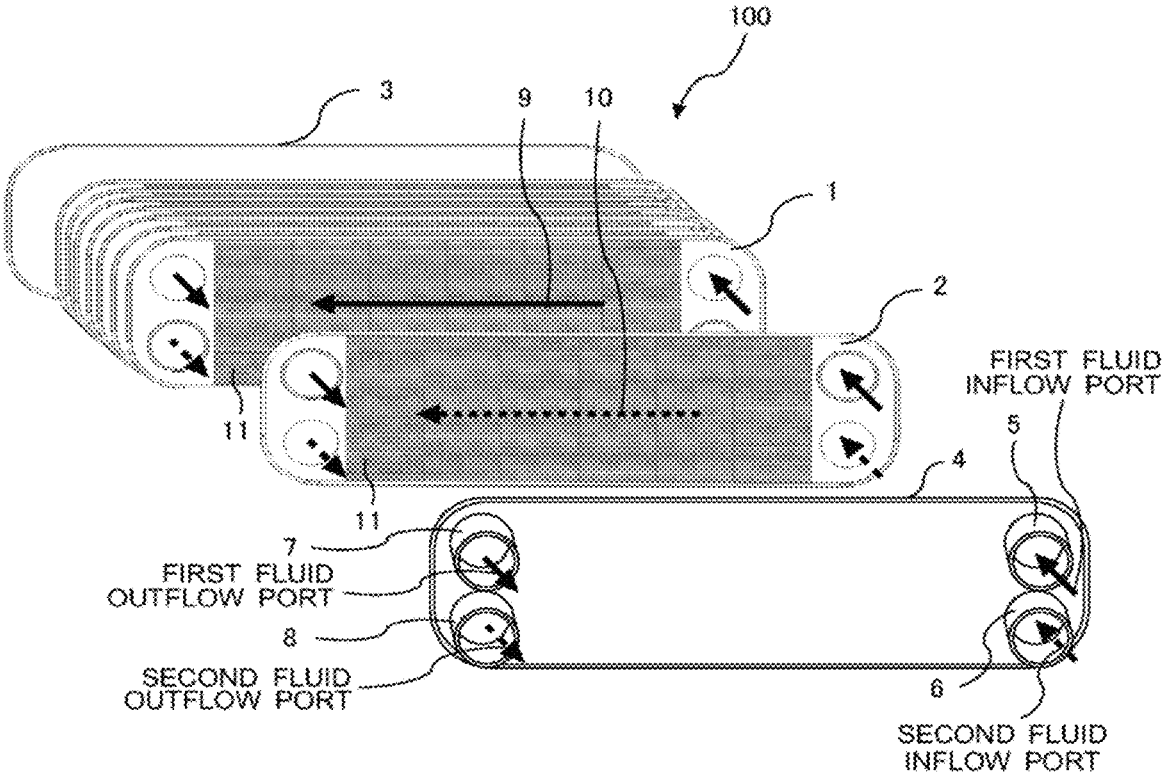
FIG. 1A is an exploded perspective view of a plate heat exchanger according to Embodiment 1 of the present invention.
Figure 1B:
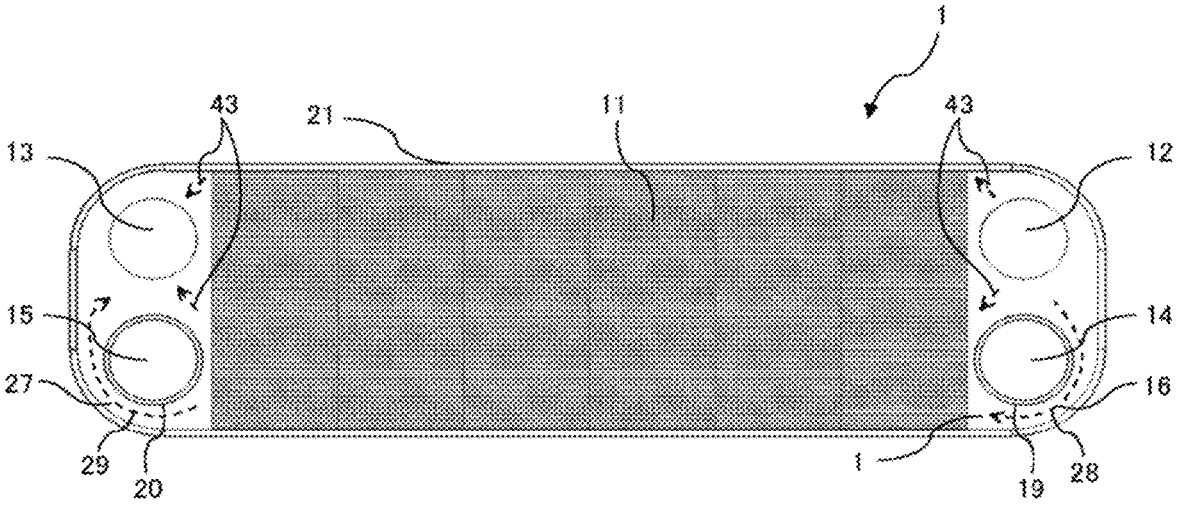
FIG. 1B is a front view illustrating a state in which a first heat transfer plate and an inner fin of the plate heat exchanger according to Embodiment 1 of the present invention are stacked in layers.
Figure 1C:
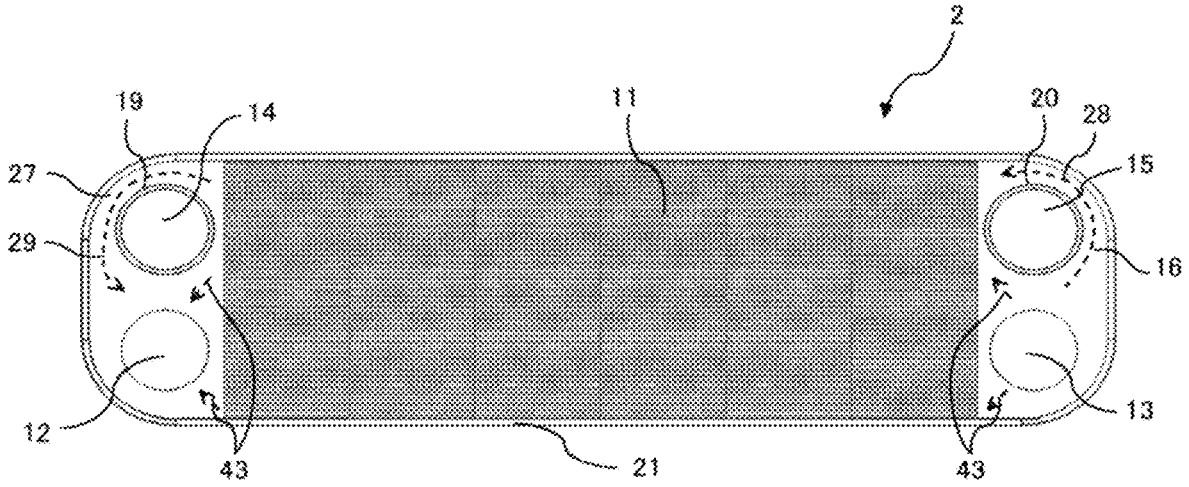
FIG. 1C is a front view illustrating a state in which a second heat transfer plate and an inner fin of the plate heat exchanger according to Embodiment 1 of the present invention are stacked in layers.
Figure 1D:
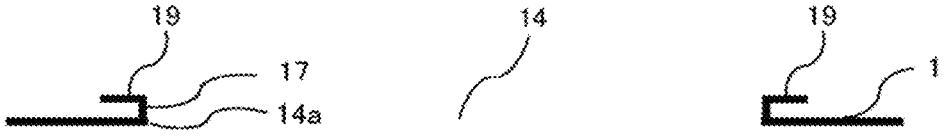
FIG. 1D is a schematic side view illustrating an adjacent hole in the second heat transfer plate of the plate heat exchanger according to Embodiment 1 of the present invention.
Figure 1E:
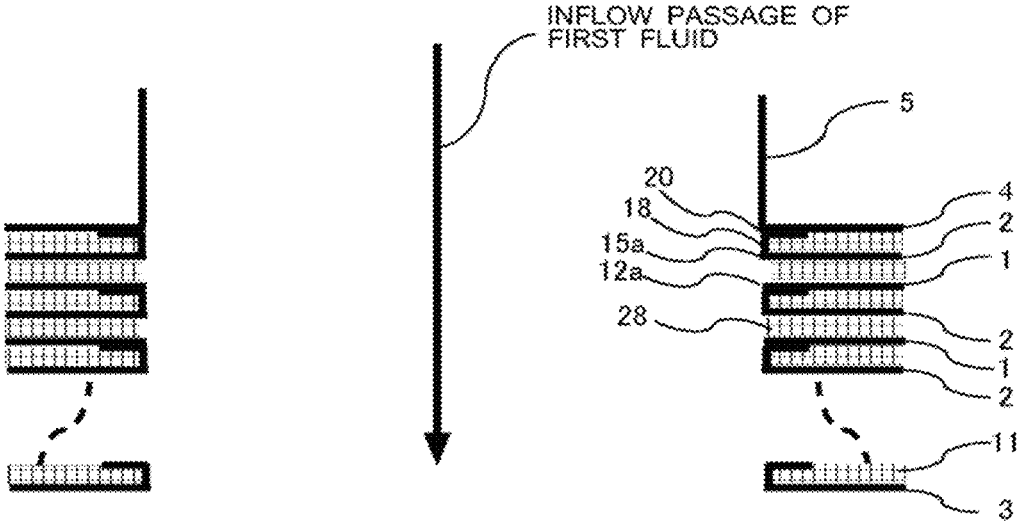
FIG. 1E is a schematic side view illustrating an inflow passage of fluid in the plate heat exchanger according to Embodiment 1 of the present invention.
Figure 1F:
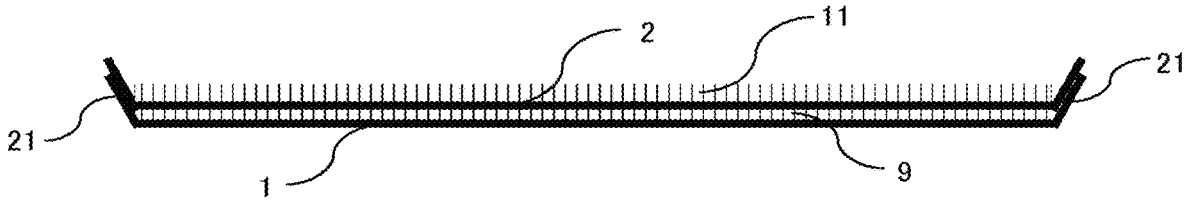
FIG. 1F is a schematic side view illustrating a state in which the first heat transfer plate and the second heat transfer plate of the plate heat exchanger according to Embodiment 1 of the present invention are stacked in layers.
Figure 1G:
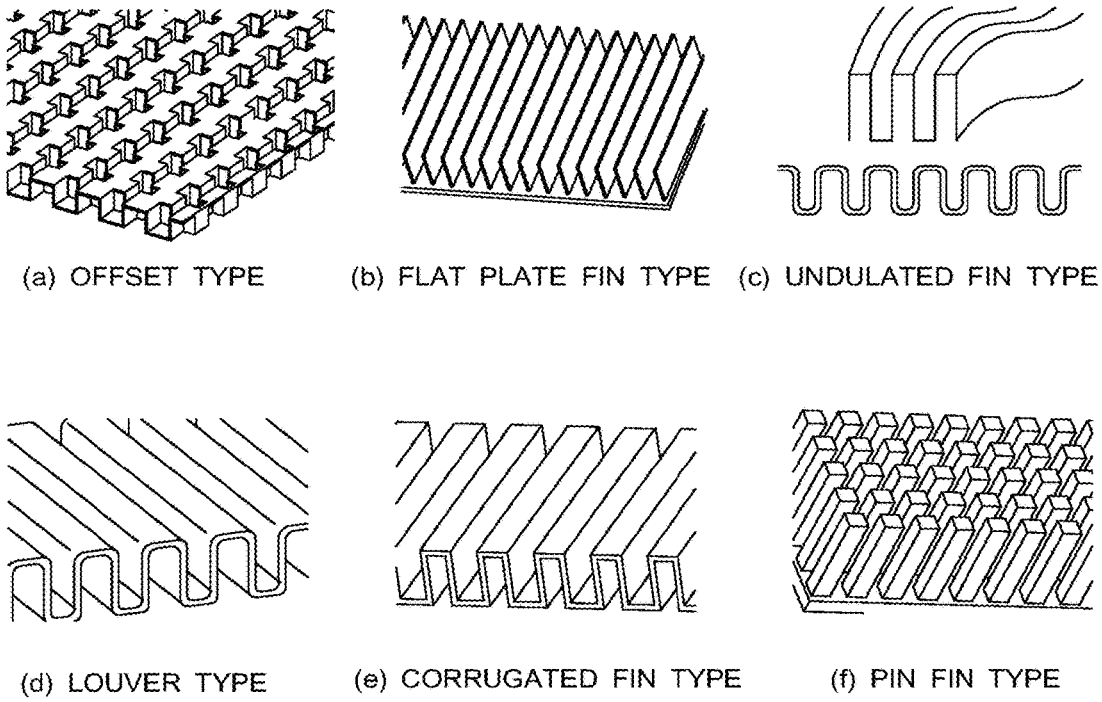
FIG. 1G includes schematic diagrams illustrating examples of the type of inner fins of the plate heat exchanger according to Embodiment 1 of the present invention.
Figure 2:
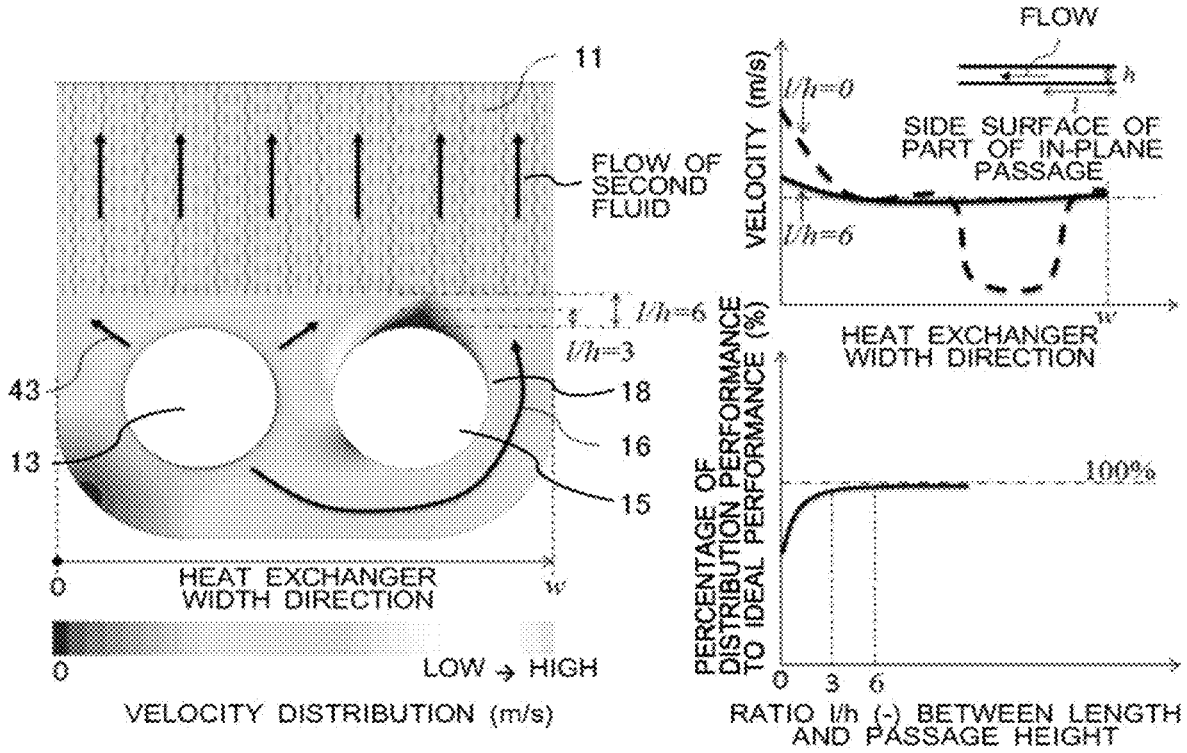
FIG. 2 includes a diagram and graphs for examining the influence of a gap between a circumferential wall of the adjacent hole in the second heat transfer plate and the inner fin of the plate heat exchanger according to Embodiment 1 of the present invention on in-plane velocity distribution and the improvement of distribution performance.

FIG. 1A is an exploded perspective view of the plate heat exchanger 100 according to Embodiment 1 of the present invention. FIG. 1B is a front view illustrating a state in which a first heat transfer plate 1 and an inner fin 11 of the plate heat exchanger 100 according to Embodiment 1 of the present invention are stacked in layers. FIG. 1C is a front view illustrating a state in which a second heat transfer plate 2 and an inner fin 11 of the plate heat exchanger 100 according to Embodiment 1 of the present invention are stacked in layers. FIG. 1D is a schematic side view illustrating an adjacent hole in the second heat transfer plate 2 of the plate heat exchanger 100 according to Embodiment 1 of the present invention. FIG. 1E is a schematic side view illustrating an inflow passage of fluid in the plate heat exchanger 100 according to Embodiment 1 of the present invention. FIG. 1F is a schematic side view illustrating a state in which the first heat transfer plate 1 and the second heat transfer plate 2 of the plate heat exchanger 100 according to Embodiment 1 of the present invention are stacked in layers. FIG. 1G includes schematic diagrams illustrating examples of the type of inner fins 11 of the plate heat exchanger 100 according to Embodiment 1 of the present invention. FIG. 2 includes a diagram and graphs for examining the influence of a gap between a circumferential wall 18 of a second adjacent hole 15 in the second heat transfer plate 2 and the inner fin 11 of the plate heat exchanger 100 according to Embodiment 1 of the present invention on in-plane velocity distribution and improvement of distribution performance.

FIG. 1D illustrates a schematic side view of a first adjacent hole 14 in the first heat transfer plate 1, and a description will be given based on the schematic side view. Each of the second adjacent hole 15 in the first heat transfer plate 1 and the first adjacent hole 14 and the second adjacent hole 15 in the second heat transfer plate 2 also has a substantially similar configuration, and thus illustration thereof will be omitted. Further, FIG. 1E illustrates a schematic side view of an inflow passage of first fluid. Each of an outflow passage of the first fluid and an inflow passage and an outflow passage of second fluid also has a substantially similar configuration, and thus illustration thereof will be omitted. Further, FIG. 2 illustrates a schematic front view of a right side portion of the second heat transfer plate 2. Each of a left side portion of the second heat transfer plate 2 and a left side portion and a right side portion of the first heat transfer plate 1 also has a substantially similar configuration, and thus illustration thereof will be omitted.

The plate heat exchanger 100 according to Embodiment 1 is of an inner fin type, with the first heat transfer plates 1, the inner fins 11, and the second heat transfer plates 2 being alternately stacked in a plurality of layers, as illustrated in FIG. 1A. Further, a first reinforcing side plate 3 and a second reinforcing side plate 4 are stacked on outermost surfaces of the layers, with the second reinforcing side plate 4 and the first reinforcing side plate 3 being stacked on a frontmost surface and a rearmost surface of the layers, respectively.

In the following, the first heat transfer plates 1 and the second heat transfer plates 2 will be collectively referred to as the heat transfer plates, and the first reinforcing side plate 3 and the second reinforcing side plate 4 will be collectively referred to as the side plates.

As illustrated in FIG. 1B, each of the first heat transfer plates 1 has a rectangular plate shape with rounded corners, and has an outer wall 21 projecting in the thickness direction around the outer circumference thereof. Further, four corners of side portions of the first heat transfer plate 1 in the horizontal direction are formed with circular holes each forming an inflow port or an outflow port of fluid. Specifically, a first passage hole 12 forming an inflow port of the first fluid is formed in an upper-right portion of the first heat transfer plate 1, and a second passage hole 13 forming an outflow port of the first fluid is formed in an upper-left portion of the first heat transfer plate 1. The first adjacent hole 14 forming an inflow port of the second fluid is formed in a lower-right portion of the first heat transfer plate 1, and the second adjacent hole 15 forming an outflow port of the second fluid is formed in a lower-left portion of the first heat transfer plate 1. Further, a first header portion 16 is provided to one side portion of the first heat transfer plate 1 in the horizontal direction, and a second header portion 27 is provided to the other side portion of the first heat transfer plate 1 in the horizontal direction.

In the following, the first passage hole 12 and the second passage hole 13 will be collectively referred to as the passage holes, and the first adjacent hole 14 and the second adjacent hole 15 will be collectively referred to as the adjacent holes. The first header portion 16 and the second header portion 27 will be collectively referred to as the header portions.

Further, as illustrated in FIG. 1D, a circumferential wall 17 is provided in the thickness direction around a circumferential edge 14*a* of the first adjacent hole 14, and a flange 19 is provided on a front surface side of the circumferential wall 17 toward the outside of the circumferential wall 17. Similarly, a circumferential wall 18 is provided in the thickness direction around a circumferential edge 15*a* of the second adjacent hole 15, and a flange 20 is provided on a front surface side of the circumferential wall 18 toward the outside of the circumferential wall 18.

As illustrated in FIG. 1B, each of the inner fins 11 has a rectangular plate shape, and is formed to be shorter than the heat transfer plates in the horizontal direction. Further, the inner fin 11 is formed with passages through which fluid flows to one side in the horizontal direction. Further, the inner fin 11 is disposed inside the first passage hole 12, the second passage hole 13, the first adjacent hole 14, and the second adjacent hole 15. Further, as illustrated in (a) to (f) of FIG. 1G, the inner fin 11 is of one of an offset type, a flat plate fin type, an undulated fin type, a louver type, a corrugated fin type, and a pin fin type, or a plurality of types selected therefrom are combined to provide the inner fin 11.

One first heat transfer plate 1 and one inner fin 11 stacked upon each other in layers as illustrated in FIG. 1B will hereinafter be referred to as the first stacked layer unit of the plate heat exchanger 100.

Further, the first fluid is a substance such as water, for example, and the second fluid is a substance such as refrigerant R410A, R32, or R290, or $CO_2$, for example.

As illustrated in FIG. 1C, each of the second heat transfer plates 2 has a rectangular plate shape with rounded corners, and is provided with the outer wall 21 projecting in the thickness direction around the outer circumference thereof. Further, four corners of side portions of the second heat transfer plate 2 in the horizontal direction are formed with circular holes each forming an inflow port or an outflow port of fluid. Specifically, the first passage hole 12 forming the outflow port of the second fluid is formed in a lower-left portion of the second heat transfer plate 2, and the second passage hole 13 forming the inflow port of the second fluid is formed in a lower-right portion of the second heat transfer plate 2. The first adjacent hole 14 forming the outflow port of the first fluid is formed in an upper-left portion of the second heat transfer plate 2, and the second adjacent hole 15 forming the inflow port of the first fluid is formed in an upper-right portion of the second heat transfer plate 2. Further, the first header portion 16 is provided to one side portion of the second heat transfer plate 2 in the horizontal direction, and the second header portion 27 is provided to the other side portion of the second heat transfer plate 2 in the horizontal direction.

Further, as illustrated in FIG. 1D, the circumferential wall 17 is provided in the thickness direction around the circumferential edge 14*a* of the first adjacent hole 14, and the flange 19 is provided on the front surface side of the circumferential wall 17 toward the outside of the circumferential wall 17, that is, toward the outside of the first adjacent hole 14. Similarly, the circumferential wall 18 is provided in the thickness direction around the circumferential edge 15*a* of the second adjacent hole 15, and the flange 20 is provided on the front surface side of the circumferential wall 18 toward the outside of the circumferential wall 18 and toward the outside of the second adjacent hole 15.

One second heat transfer plate 2 and one inner fin 11 stacked upon each other in layers as illustrated in FIG. 1C will hereinafter be referred to as the second stacked layer unit of the plate heat exchanger 100.

Further, in spaces in the horizontal direction located between adjacent ones of the first heat transfer plates 1 and the second heat transfer plates 2 and not provided with the inner fin 11, there are formed a bypass passage 28 that is a passage allowing the fluid flowing from one of the passage holes to pass a side farther than one of the adjacent holes, a merging passage 29 that is a passage allowing the fluid flowing from the inner fin 11 to pass a side farther than the other one of the adjacent holes, and a main passage 43 that includes a passage allowing the fluid flowing from the one of the passage holes to directly flow toward the inner fin 11 without routing through the bypass passage 28 and a passage allowing the fluid flowing from the inner fin 11 to directly flow toward the other one of the passage holes without routing through the merging passage 29 (refer to FIGS. 1B, 1C, and 1E).

Specifically, as illustrated in FIGS. 1B and 1C, in the space located between the first header portion 16 of the first heat transfer plate 1 and the first header portion 16 of the second heat transfer plate 2, not provided with the inner fin 11, and excluding the spaces inside the circumferential walls 17 and 18, there are formed the bypass passage 28 allowing the first fluid or the second fluid to pass the side farther than the first adjacent hole 14 or the second adjacent hole 15 while spreading in the vertical direction and then flow into the inner fin 11 and the main passage 43 allowing the first fluid or the second fluid to directly flow toward the inner fin without routing through the bypass passage 28.

Further, in the space located between the second header portion 27 of the first heat transfer plate 1 and the second header portion 27 of the second heat transfer plate 2, not provided with the inner fin 11, and excluding the spaces inside the circumferential walls 17 and 18, there are formed the merging passage 29 allowing the first fluid or the second fluid flowing from the inner fin 11 to pass the side farther than the second adjacent hole 15 or the first adjacent hole 14 while gathering toward the corresponding outflow port in the vertical direction and the main passage 43 allowing the first fluid or the second fluid to directly flow toward the second passage hole 13 or the first passage hole 12 without routing through the bypass passage 28.

There is a flat space around the entire circumference of the first adjacent hole 14 or the second adjacent hole 15, allowing the first fluid or the second fluid flowing through the main passage 43 and the first fluid or the second fluid flowing through the bypass passage 28 to merge and be uniformized and rectified in a gap between the circumferential wall 17 or 18 and the inner fin 11 (a part of the aforementioned space). Since an excessively short interval between the circumferential wall 17 or 18 and the inner fin 11 results in a reduced effect of uniformization and rectification, as described later, the length of the gap between the circumferential wall 17 or 18 and the inner fin 11 is greater than the height of the passages, desirably three times or greater than the height of the passages.

Figure 10:
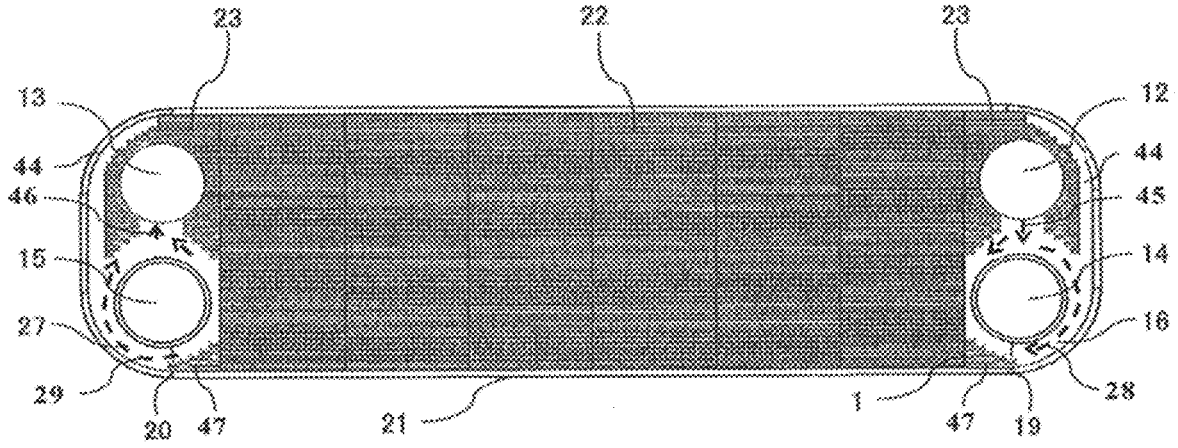
FIG. 10 is a front view illustrating a state in which a first heat transfer plate and an inner fin of a plate heat exchanger according to Embodiment 8 of the present invention are stacked in layers.

As understood from FIGS. 1B and 10, the first passage hole 12 and the second adjacent hole 15 are formed at reversed positions between the first heat transfer plate 1 and the second heat transfer plate 2, and the second passage hole 13 and the first adjacent hole 14 are formed at reversed positions between the first heat transfer plate 1 and the second heat transfer plate 2.

As illustrated in FIG. 1A, the first reinforcing side plate 3 has a rectangular plate shape with rounded corners. Further, as illustrated in FIG. 1A, the second reinforcing side plate 4 has a rectangular plate shape with rounded corners, and four corners of side portions of the second reinforcing side plate 4 in the horizontal direction are formed with circular holes each forming an inflow port or an outflow port of fluid. Further, a circumferential edge of each of the holes is provided with a cylindrical inflow pipe or outflow pipe. Specifically, the circumferential edge of the upper-right hole forming the inflow port of the first fluid is provided with a first inflow pipe 5, and the circumferential edge of the lower-right hole forming the inflow port of the second fluid is provided with a second inflow pipe 6. The circumferential edge of the upper-left hole forming the outflow port of the first fluid is provided with a first outflow pipe 7, and the circumferential edge of the lower-left hole forming the outflow port of the second fluid is provided with a second outflow pipe 8.

In the plate heat exchanger 100, the first stacked layer units and the second stacked layer units are alternately stacked in layers. Herein, the first stacked layer units and the second stacked layer units are stacked in layers such that the first passage hole 12 in the first heat transfer plate 1 and the second adjacent hole 15 in the second heat transfer plate 2 each forming the inflow port of the first fluid are superimposed on each other, and that the second passage hole 13 in the first heat transfer plate 1 and the first adjacent hole 14 in the second heat transfer plate 2 each forming the outflow port of the first fluid are superimposed on each other. Further, the first stacked layer units and the second stacked layer units are stacked in layers such that the first adjacent hole 14 in the first heat transfer plate 1 and the second passage hole 13 in the second heat transfer plate 2 each forming the inflow port of the second fluid are superimposed on each other, and that the second adjacent hole 15 in the first heat transfer plate 1 and the first passage hole 12 in the second heat transfer plate 2 each forming the outflow port of the second fluid are superimposed on each other.

Further, the second reinforcing side plate 4 and one of the second stacked layer units are stacked in layers such that the first inflow pipe 5 is superimposed on the second adjacent hole 15 forming the inflow port of the first fluid, that the first outflow pipe 7 is superimposed on the first adjacent hole 14 forming the outflow port of the first fluid, that the second inflow pipe 6 is superimposed on the second passage hole 13 forming the inflow port of the second fluid, and that the second outflow pipe 8 is superimposed on the first passage hole 12 forming the outflow port of the second fluid. Further, the first stacked layer units, the second stacked layer units, and the first reinforcing side plate 3 are stacked in layers such that respective outer circumferential edges thereof are superimposed on one another and joined together with a brazing material or another material. Herein, in the first stacked layer units and the second stacked layer units as viewed in the stacking direction, the rear surface of each heat transfer plate and the inner fin 11 adjacent to the heat transfer plate are joined together, and overlapping portions of the rear surface of the heat transfer plate and the flanges 19 and 20 provided to another heat transfer plate adjacent to the heat transfer plate are joined together, as well as the outer walls 21 joined together.

With the thus-stacked layers, an inflow passage and an inflow hole for the first fluid are formed with the circumferential edge of the hole in the second reinforcing side plate 4 forming the inflow port of the first fluid, the first inflow pipe 5, the circumferential edge 15*a* of the second adjacent hole 15 in the second heat transfer plate 2, the circumferential wall 18, the flange 20, and a circumferential edge 12*a* of the first passage hole 12 in the first heat transfer plate 1, as illustrated in FIG. 1E. Similarly, an outflow passage and an outflow hole for the first fluid are formed with the circumferential edge of the upper-left hole in the second reinforcing side plate 4 forming the outflow port of the first fluid, the first outflow pipe 7, the circumferential edge 14*a* of the first adjacent hole 14 in the second heat transfer plate 2, the circumferential wall 17, the flange 19, and a circumferential edge 13*a* of the second passage hole 13 in the first heat transfer plate 1.

Further, an inflow passage and an inflow hole for the second fluid are formed with the circumferential edge of the hole in the second reinforcing side plate 4 forming the inflow port of the second fluid, the second inflow pipe 6, the circumferential edge 13*a* of the second passage hole 13 in the second heat transfer plate 2, the circumferential edge of the first adjacent hole 14 in the first heat transfer plate 1, the circumferential wall 17, and the flange 19. Similarly, an outflow passage and an outflow hole for the second fluid are formed with the circumferential edge of the hole in the second reinforcing side plate 4 forming the outflow port of the second fluid, the second outflow pipe 8, the circumferential edge 12*a* of the first passage hole 12 in the second heat transfer plate 2, the circumferential edge 15*a* of the second adjacent hole 15 in the first heat transfer plate 1, the circumferential wall 18, and the flange 20.

Herein, the flanges 19 and 20 provided to the circumferential walls 17 and 18 of the first adjacent hole 14 and the second adjacent hole 15 in the second heat transfer plate 2 contact the rear surface of the corresponding first heat transfer plate 1, and there is a gap between the circumferential edges of the first passage hole 12 and the second passage hole 13 in the second heat transfer plate 2 and the rear surface of the first heat transfer plate 1. Therefore, the first fluid flowing from the first inflow pipe 5 flows into between the rear surface of the second heat transfer plate 2 and the front surface of the first heat transfer plate 1, but not between the rear surface of the first heat transfer plate 1 and the front surface of the second heat transfer plate 2. Similarly, the first fluid flows into the first outflow pipe 7 from between the rear surface of the second heat transfer plate 2 and the front surface of the first heat transfer plate 1, but not between the rear surface of the first heat transfer plate 1 and the front surface of the second heat transfer plate 2.

Further, the flanges 19 and 20 provided to the circumferential walls 17 and 18 of the first adjacent hole 14 and the second adjacent hole 15 in the first heat transfer plate 1 contact the rear surface of the corresponding second heat transfer plate 2, and there is a gap between the circumferential edges of the first passage hole 12 and the second passage hole 13 in the first heat transfer plate 1 and the rear surface of the second heat transfer plate 2. Therefore, the second fluid flowing from the second inflow pipe 6 flows into between the rear surface of the first heat transfer plate 1 and the front surface of the second heat transfer plate 2, but not between the rear surface of the second heat transfer plate 2 and the front surface of the first heat transfer plate 1. Similarly, the second fluid flows into the second outflow pipe 8 from between the rear surface of the first heat transfer plate 1 and the front surface of the second heat transfer plate 2, but not between the rear surface of the second heat transfer plate 2 and the front surface of the first heat transfer plate 1.

Further, with the inner fin 11 disposed between the rear surface of the second heat transfer plate 2 and the front surface of the first heat transfer plate 1, first micro-channel passages 9 through which the first fluid flows to one side in the horizontal direction are provided in parallel in the vertical direction in the passage of the first fluid, as illustrated in FIG. 1A. Since the heat transfer plates are provided with the circumferential walls 17 and 18 and the flanges 19 and 20, a gap is formed between adjacent ones of the heat transfer plates or between adjacent ones of the heat transfer plates and the side plates. Therefore, the bypass passage 28 and the merging passage 29 forming passages of fluid are formed in the spaces in the horizontal direction located between the adjacent ones of the heat transfer plates or between the adjacent ones of the heat transfer plates and the side plates and not provided with the inner fin 11.

Further, the first fluid flowing into the plate heat exchanger 100 from the first inflow pipe 5 flows through the inflow passage of the first fluid, which is formed with the first heat transfer plate 1 and the second heat transfer plate 2 superimposed on each other, and flows into the respective first micro-channel passages 9. In this process, the first fluid flows in the horizontal direction while spreading in the vertical direction in the bypass passage 28 upstream of the first micro-channel passages 9, and flows through the respective first micro-channel passages 9 provided in parallel. The flows of the first fluid then merge in the merging passage 29 downstream of the first micro-channel passages 9, and thereafter the first fluid flows through the outflow passage of the first fluid, which is formed with the first heat transfer plate 1 and the second heat transfer plate 2 superimposed on each other, and flows to the outside of the plate heat exchanger 100 from the first outflow pipe 7.

Further, with the inner fin 11 disposed between the rear surface of the first heat transfer plate 1 and the front surface of the second heat transfer plate 2, second micro-channel passages 10 through which the second fluid flows to one side in the horizontal direction are provided in parallel in the vertical direction in the passage of the second fluid, as illustrated in FIG. 1A. Therefore, the bypass passage 28 and the merging passage 29 forming passages of fluid are formed in the spaces in the horizontal direction located between adjacent ones of the heat transfer plates and not provided with the inner fin 11.

The first micro-channel passages 9 and the second micro-channel passages 10 will hereinafter be collectively referred to as the micro-channel passages.

Further, the first micro-channel passages 9 correspond to "first passages" of the present invention, and the second micro-channel passages 10 correspond to "second passages" of the present invention.

Further, the second fluid flowing into the plate heat exchanger 100 from the second inflow pipe 6 flows through the inflow passage of the second fluid, which is formed with the first heat transfer plate 1 and the second heat transfer plate 2 superimposed on each other, and flows into the respective second micro-channel passages 10. In this process, the second fluid flows in the horizontal direction while spreading in the vertical direction in the bypass passage 28 upstream of the second micro-channel passages 10, and flows through the respective second micro-channel passages 10 provided in parallel. The flows of the second fluid then merge in the merging passage 29 downstream of the second micro-channel passages 10, and thereafter the second fluid flows through the outflow passage of the second fluid, which is formed with the first heat transfer plate 1 and the second heat transfer plate 2 superimposed on each other, and flows to the outside of the plate heat exchanger 100 from the second outflow pipe 8.

Characteristics of the plate heat exchanger 100 according to Embodiment 1 will now be described.

In the plate heat exchanger 100, the bypass passage 28 and the merging passage 29 are formed in the spaces in the horizontal direction located between adjacent ones of the first heat transfer plates 1 and the second heat transfer plates 2 and not provided with the inner fin 11. That is, the bypass passage 28 is formed in the space located between the first header portion 16 of the first heat transfer plate 1 and the first header portion 16 of the second heat transfer plate 2 and not provided with the inner fin 11, and the merging passage 29 is formed in the space located between the second header portion 27 of the first heat transfer plate 1 and the second header portion 27 of the second heat transfer plate 2 and not provided with the inner fin 11. Further, the plate heat exchanger 100 according to Embodiment 1 is characterized in allowing fluid to flow in the horizontal direction while spreading in the vertical direction in the bypass passage 28, and then flow through the micro-channel passages. Further, the bypass passage 28 and the merging passage 29 according to Embodiment 1 correspond to all spaces in each of the heat transfer plates not provided with the inner fin 11, excluding the spaces inside the circumferential walls 17 and 18, and allowing the fluid flowing in the vertical direction to pass the side farther than the adjacent holes. Therefore, the plate heat exchanger 100 according to Embodiment 1 is characterized in having the large bypass passage 28 and the large merging passage 29.

Further, as illustrated in FIG. 1F, the plate heat exchanger 100 according to Embodiment 1 is characterized in that the outer walls 21 of the first heat transfer plates 1 and the outer walls 21 of the second heat transfer plates 2 are both provided to be tilted outward with respect the thickness direction, and that an area of contact between a tip end portion of the inside of the outer wall 21 and a portion of the outside of the outer wall 21 of another heat transfer plate adjacent thereto are joined together by brazing. Thereby, the fluid flows in the horizontal direction while spreading in the vertical direction, therefore enabling improvement of in-plane distribution uniformity of the heat transfer plates. It is also possible to increase the effective heat transfer area of the header portions of the heat transfer plates, and to prevent the occurrence of stagnation of an in-plane flow on the heat transfer plates. Further, since the bypass passage 28 and the merging passage 29 are large, the flow rate of the fluid flowing through the bypass is high, which makes the bypass less likely to be blocked with dust or frozen.

Further, with the bypass passage 28 and the merging passage 29, the cross sections of passages near in-plane inflow and outflow ports of the heat transfer plates are increased, therefore reducing overall pressure loss. Further, the plate heat exchanger 100 according to Embodiment 1 is formed only of the heat transfer plates, the side plates, and the inner fins 11, and thus is simplified in structure and reduced in cost.

Further, as illustrated in FIG. 2, as a quantitative evaluation parameter for evaluating the uniformization and rectification of the first fluid or the second fluid flowing through the main passage 43 and the first fluid or the second fluid flowing through the bypass passage 28 in the gap between the circumferential wall 18 of the second adjacent hole 15 and the inner fin 11, the ratio between the length of the gap between the circumferential wall 18 of the second adjacent hole 15 and the inner fin 11 and a passage height, that is, the height of the circumferential wall 18 with respect to the surface of the second heat transfer plate 2 provided with the circumferential wall 18, is defined as "l/h," and in-plane distribution performance substantially reaches ideal distribution performance. Therefore, the plate heat exchanger 100 according to Embodiment 1 is characterized in that the second adjacent hole 15 and the inner fin 11 are provided with "l/h" of three or greater.

In Embodiment 1, the flowing direction in the first passages and the flowing direction in the second passages are the same in the horizontal direction (the longitudinal direction of the rectangles). However, the flowing direction in the first passages and the flowing direction in the second passages are not limited thereto, and may be opposite to each other in the horizontal direction. That is, the inflow port and the outflow port of the first passages or the second passages may be reversed in position.

Embodiment 2

Embodiment 2 will be described below. Description of parts overlapping those of Embodiment 1 will be omitted, and parts the same as or corresponding to those of Embodiment 1 will be assigned with the same reference signs.

Figure 3:
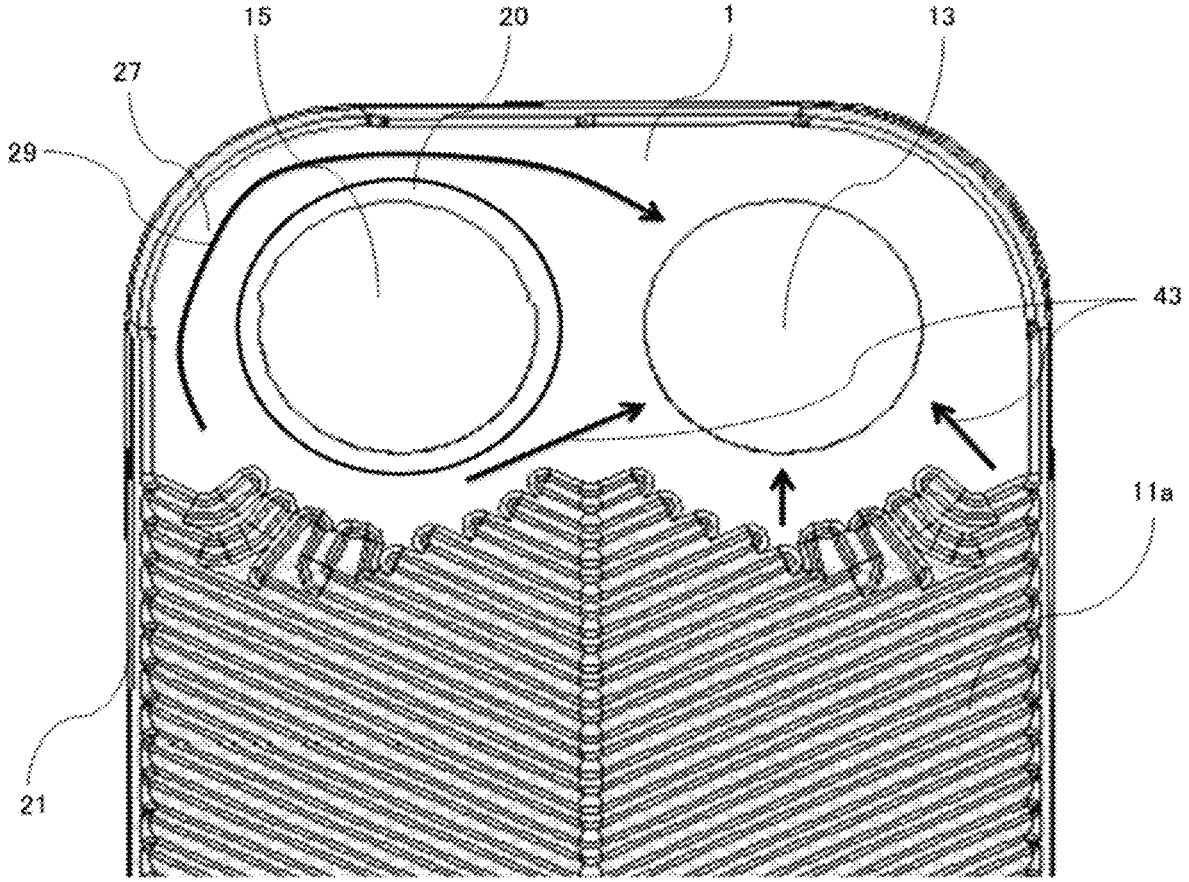
FIG. 3 is an enlarged front view illustrating a periphery of a header portion of a heat transfer plate of a plate heat exchanger according to Embodiment 2 of the present invention.

FIG. 3 is an enlarged front view illustrating a periphery of a header portion of a heat transfer plate of a plate heat exchanger according to Embodiment 2 of the present invention.

FIG. 3 illustrates an enlarged view of a periphery of the second header portion 27 of the first heat transfer plate 1. A periphery of each of the first header portion 16 of the first heat transfer plate 1 and the first header portion 16 and the second header portion 27 of the second heat transfer plate 2 also has a substantially similar configuration, and thus description and illustration thereof will be omitted.

As illustrated in FIG. 3, the first heat transfer plate 1 per se includes a corrugated heat transfer surface 11*a*, and the second header portion 27 is formed with the second adjacent hole 15 and the second passage hole 13 described in Embodiment 1. Further, the plate heat exchanger according to Embodiment 2 is characterized in that the first fluid passes through the merging passage 29 or the main passage 43 and then flows into the second passage hole 13.

The plate heat exchanger according to Embodiment 2 is capable of obtaining effects similar to those of Embodiment 1.

Embodiment 3

Embodiment 3 will be described below. Description of parts overlapping those of Embodiments 1 and 2 will be omitted, and parts the same as or corresponding to those of Embodiments 1 and 2 will be assigned with the same reference signs.

Figure 4A:
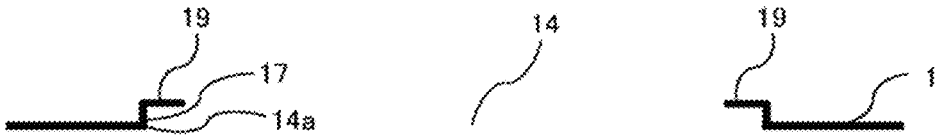
FIG. 4A is a schematic side view illustrating an adjacent hole in a heat transfer plate of a plate heat exchanger according to Embodiment 3 of the present invention.
Figure 4B:
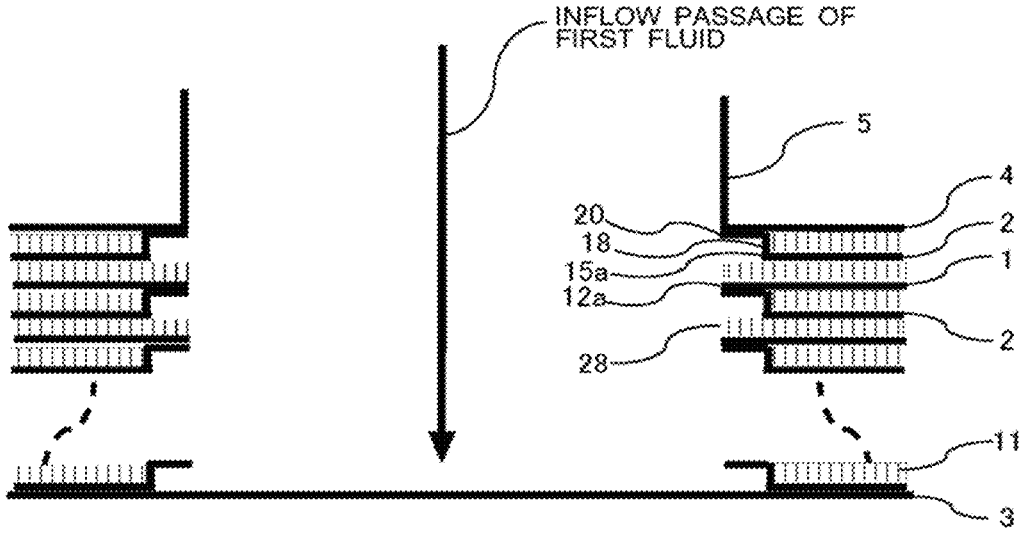
FIG. 4B is a schematic side view illustrating an inflow passage of fluid in the plate heat exchanger according to Embodiment 3 of the present invention.

FIG. 4A is a schematic side view illustrating an adjacent hole in a heat transfer plate of a plate heat exchanger according to Embodiment 3 of the present invention. FIG. 4B is a schematic side view illustrating an inflow passage of fluid in the plate heat exchanger according to Embodiment 3 of the present invention.

FIG. 4B illustrates a schematic side view of the first adjacent hole 14 in the first heat transfer plate 1, and a description will be given based on the schematic side view. Each of the second adjacent hole 15 in the first heat transfer plate 1 and the first adjacent hole 14 and the second adjacent hole 15 in the second heat transfer plate 2 also has a substantially similar configuration, and thus description and illustration thereof will be omitted. Further, FIG. 4A illustrates a schematic side view of the inflow passage of the first fluid. Each of the outflow passage of the first fluid and the inflow passage and the outflow passage of the second fluid also has a substantially similar configuration, and thus description and illustration thereof will be omitted.

In the plate heat exchanger according to Embodiment 3, the flange 19 is provided on the front surface side of the circumferential wall 17 provided around the circumferential edge 14*a* of the first adjacent hole 14 toward the inside of the circumferential wall 17, that is, toward the inside of the first adjacent hole 14, as illustrated in FIG. 4A. Similarly, the flange 20 is provided on the front surface side of the circumferential wall 18 provided around the circumferential edge 15*a* of the second adjacent hole 15 toward the inside of the circumferential wall 18, that is, toward the inside of the second adjacent hole 15.

The flanges 19 and 20 provided toward the inside of the circumferential walls 17 and 18, that is, toward the inside of the first adjacent hole 14 and the second adjacent hole 15, as in Embodiment 3, are more workable than the flanges 19 and 20 provided toward the outside of the circumferential walls 17 and 18, therefore enabling a further reduction in the cost of the plate heat exchanger.

Embodiment 4

Embodiment 4 will be described below. Description of parts overlapping those of Embodiments 1 to 3 will be omitted, and parts the same as or corresponding to those of Embodiments 1 to 3 will be assigned with the same reference signs.

Figure 5:
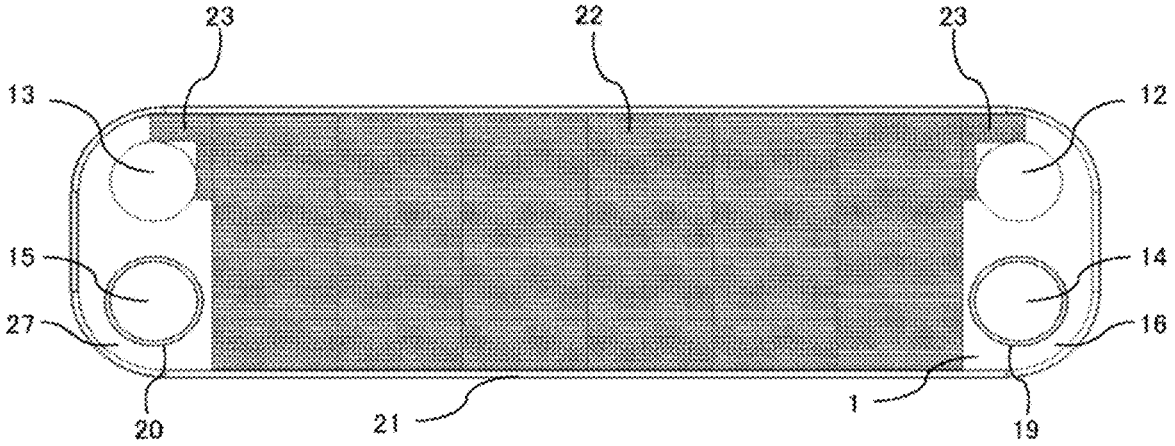
FIG. 5 is a front view illustrating a state in which a first heat transfer plate and an inner fin of a plate heat exchanger according to Embodiment 4 of the present invention are stacked in layers.

FIG. 5 is a front view illustrating a state in which the first heat transfer plate 1 and an inner fin of a plate heat exchanger according to Embodiment 4 of the present invention are stacked in layers.

FIG. 5 is a diagram illustrating the first heat transfer plate 1 and the inner fin stacked in layers, and a description will be given based on the diagram. The second heat transfer plate 2 and the inner fin stacked in layers also have a substantially similar configuration, and thus description and illustration thereof will be omitted.

In Embodiment 4, the inner fin is formed of a central fin 22 and side fins 23, which are integrated together. The central fin 22 is provided with a shape similar to the shape of the inner fin 11 according to Embodiments 1 and 2, and is disposed at a position similar to the position of the inner fin 11 according to Embodiments 1 and 2. The side fins 23 are provided to parts of the outsides of opposite side portions of the rectangular central fin 22 in the horizontal direction, and are disposed near the first passage hole 12 and the second passage hole 13, that is, near the in-plane inflow and outflow ports in the first heat transfer plate 1.

Further, the side fins 23 are each characterized in having an "L"-shape disposed to fit a half or less of the circumferential edge of the first passage hole 12 or the second passage hole 13.

Figure 6A:
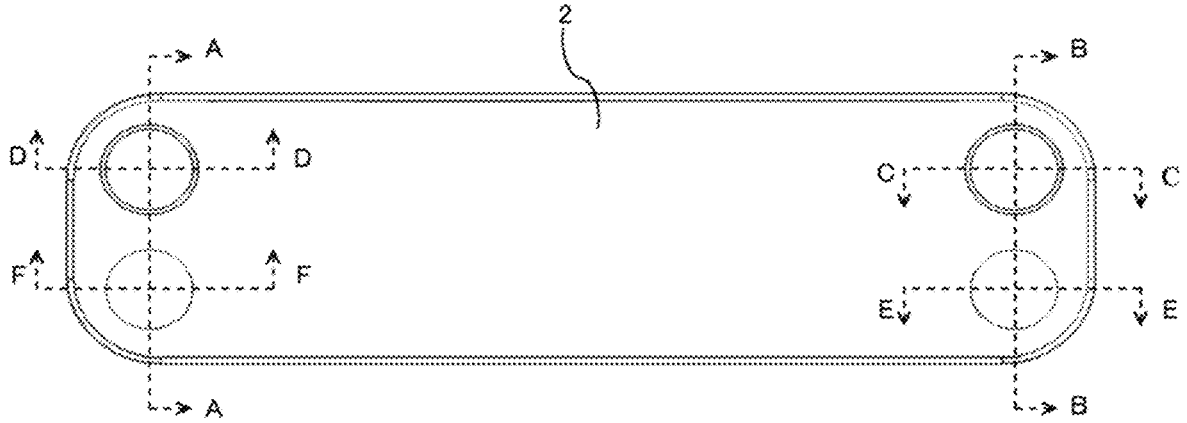
FIG. 6A is a front view illustrating a state in which the first heat transfer plate, the inner fin, and a second heat transfer plate of the plate heat exchanger according to Embodiment 4 of the present invention are stacked in layers.
Figure 6B:
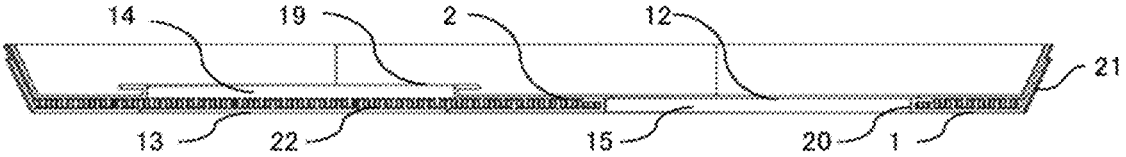
FIG. 6B is a cross-sectional view taken along line A-A in FIG. 6A.
Figure 6C:
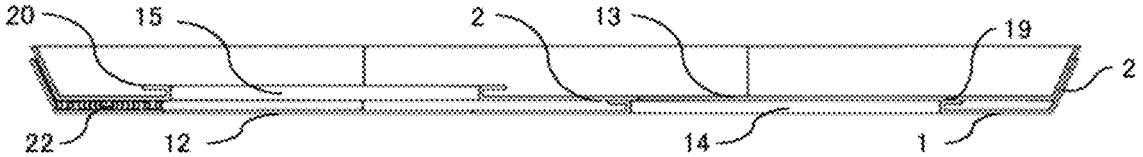
FIG. 6C is a cross-sectional view taken along line B-B in FIG. 6A.
Figure 6D:
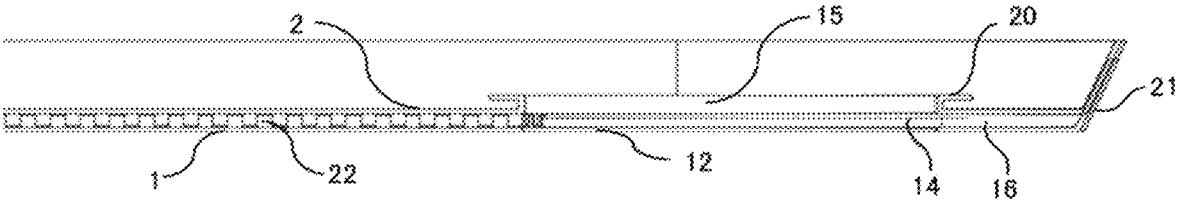
FIG. 6D is a cross-sectional view taken along line C-C in FIG. 6A.
Figure 6E:
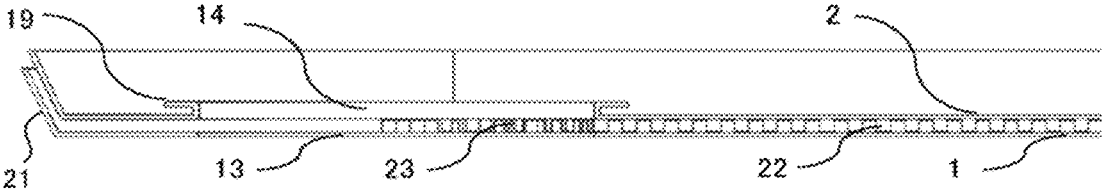
FIG. 6E is a cross-sectional view taken along line D-D in FIG. 6A.
Figure 6F:
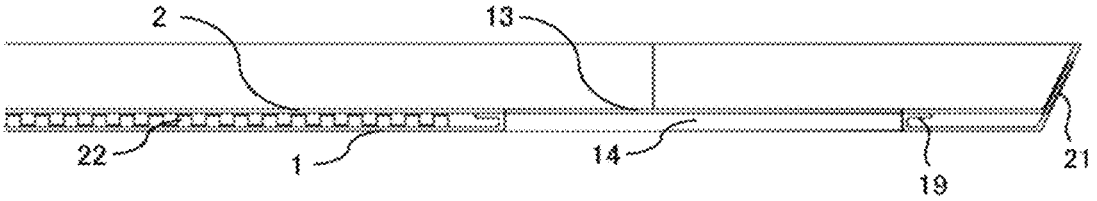
FIG. 6F is a cross-sectional view taken along line E-E in FIG. 6A.
Figure 6G:
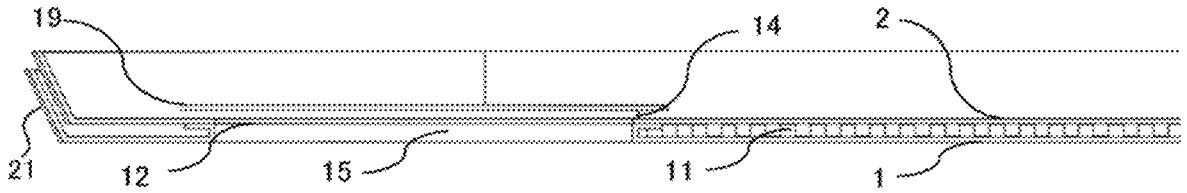
FIG. 6G is a cross-sectional view taken along line F-F in FIG. 6A.

FIG. 6A is a front view illustrating a state in which the first heat transfer plate 1, the inner fin, and the second heat transfer plate 2 of the plate heat exchanger according to Embodiment 4 of the present invention are stacked in layers. FIG. 6B is a cross-sectional view taken along line A-A in FIG. 6A. FIG. 6C is a cross-sectional view taken along line B-B in FIG. 6A. FIG. 6D is a cross-sectional view taken along line C-C in FIG. 6A. FIG. 6E is a cross-sectional view taken along line D-D in FIG. 6A. FIG. 6F is a cross-sectional view taken along line E-E in FIG. 6A. FIG. 6G is a cross-sectional view taken along line F-F in FIG. 6A.

The inner fin according to Embodiment 4 includes the side fins 23, and thus is characterized in having a shape in which the distance between the inner fin and each of the first passage hole 12 and the second passage hole 13 forming the inflow port or the outflow port of the first fluid is shorter than the distance between the inner fin and each of the first adjacent hole 14 and the second adjacent hole 15 forming the inflow port or the outflow port of the second fluid, as illustrated in FIGS. 6A to 6G.

The first heat transfer plate 1 and the second heat transfer plate 2 may each have the corrugated heat transfer surface 11*a*, instead of having the inner fin stacked on the first heat transfer plate 1 and the second heat transfer plate 2 in layers. Further, in such a case, each of the first heat transfer plate 1 and the second heat transfer plate 2 has a shape in which the distance between the corrugated heat transfer surface 11*a* and each of the first passage hole 12 and the second passage hole 13 forming the inflow port or the outflow port of the first fluid is shorter than the distance between the corrugated heat transfer surface 11*a* and each of the first adjacent hole 14 and the second adjacent hole 15 forming the inflow port or the outflow port of the second fluid.

The side fins 23 each having an "L"-shape are thus provided near the first passage hole 12 and the second passage hole 13 each forming the inflow port or the outflow port of the first fluid, thereby making it possible to provide resistance to a passage through which the first fluid is likely to flow from the inflow port to the outflow port. Therefore, the first fluid spreads more in the vertical direction in the bypass passage 28 than in the bypass passage 28 in Embodiments 1 and 2, thereby enabling further improvement of the in-plane distribution uniformity of the heat transfer plates.

Further, with the inner fin including the side fins 23, it is possible to further increase the effective heat transfer area of the header portions forming the side portions of the heat transfer plates.

Embodiment 5

Embodiment 5 will be described below. Description of parts overlapping those of Embodiments 1 to 4 will be omitted, and parts the same as or corresponding to those of Embodiments 1 to 4 will be assigned with the same reference signs.

Figure 7:
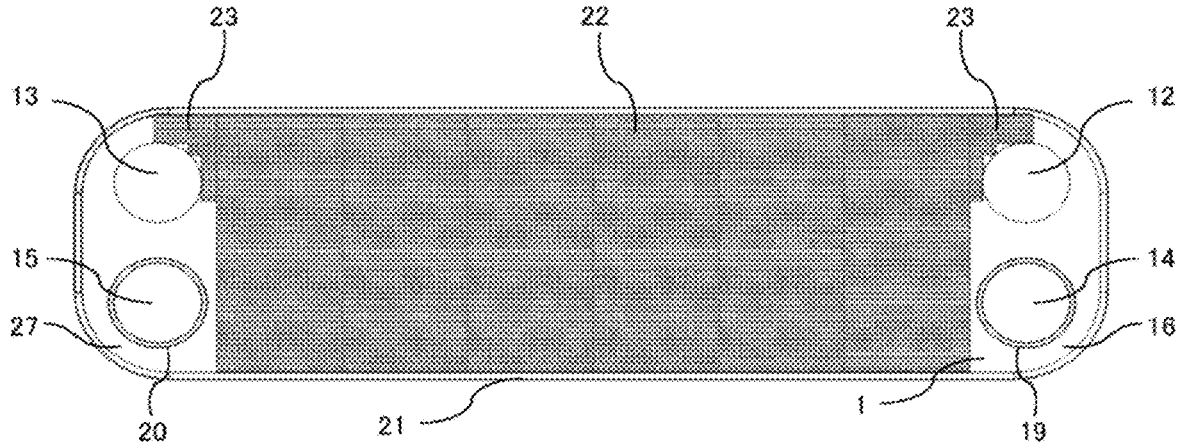
FIG. 7 is a front view illustrating a state in which a first heat transfer plate and an inner fin of a plate heat exchanger according to Embodiment 5 of the present invention are stacked in layers.

FIG. 7 is a front view illustrating a state in which the first heat transfer plate 1 and an inner fin of a plate heat exchanger according to Embodiment 5 of the present invention are stacked in layers.

FIG. 7 is a diagram illustrating the first heat transfer plate 1 and the inner fin stacked in layers, and a description will be given based on the diagram. The second heat transfer plate 2 and the inner fin stacked in layers also have a substantially similar configuration, and thus description and illustration thereof will be omitted.

In Embodiment 5, the inner fin is formed of the central fin 22 and the side fins 23, which are integrated together. The central fin 22 is provided with a shape similar to the shape of the inner fin 11 according to Embodiments 1 and 2, and is disposed at a position similar to the position of the inner fin 11 according to Embodiments 1 and 2. The side fins 23 are provided to parts of the outsides of the opposite side portions of the rectangular central fin 22 in the horizontal direction, and are disposed near the first passage hole 12 and the second passage hole 13, that is, near the in-plane inflow and outflow ports in the first heat transfer plate 1.

Further, the side fins 23 are each characterized in having two or more "L"-shapes disposed to fit a half or less of the circumferential edge of the first passage hole 12 or the second passage hole 13.

The side fins 23 each having two or more "L"-shapes are thus provided near the first passage hole 12 and the second passage hole 13 each forming the inflow port or the outflow port of the first fluid, thereby making it possible to provide higher resistance to the passage through which the first fluid is likely to flow from the inflow port to the outflow port than the resistance provided in Embodiment 3. It is therefore possible to further improve the in-plane distribution of the heat transfer plates and increase the effective heat transfer area of the header portions of the heat transfer plates, while maintaining the effects of Embodiment 4.

Embodiment 6

Embodiment 6 will be described below. Description of parts overlapping those of Embodiments 1 to 5 will be omitted, and parts the same as or corresponding to those of Embodiments 1 to 5 will be assigned with the same reference signs.

Figure 8:
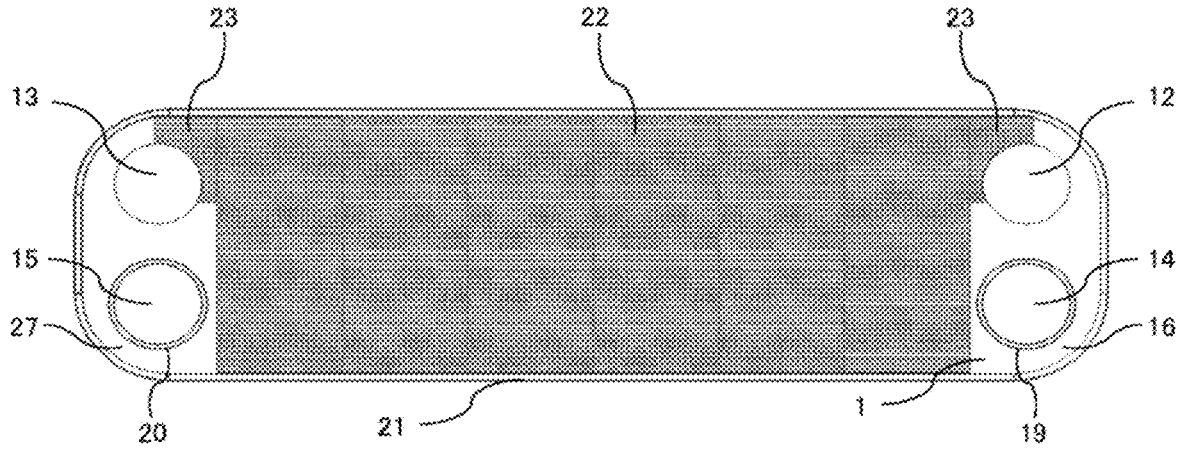
FIG. 8 is a front view illustrating a state in which a first heat transfer plate and an inner fin of a plate heat exchanger according to Embodiment 6 of the present invention are stacked in layers.

FIG. 8 is a front view illustrating a state in which the first heat transfer plate 1 and an inner fin of a plate heat exchanger according to Embodiment 6 of the present invention are stacked in layers.

FIG. 8 is a diagram illustrating the first heat transfer plate 1 and the inner fin stacked in layers, and a description will be given based on the diagram. The second heat transfer plate 2 and the inner fin stacked in layers also have a substantially similar configuration, and thus description and illustration thereof will be omitted.

In Embodiment 6, the inner fin is formed of the central fin 22 and the side fins 23, which integrated together. The central fin 22 is provided with a shape similar to the shape of the inner fin 11 according to Embodiments 1 and 2, and is disposed at a position similar to the position of the inner fin 11 according to Embodiments 1 and 2. The side fins 23 are provided to parts of the outsides of the opposite side portions of the rectangular central fin 22 in the horizontal direction, and are disposed near the first passage hole 12 and the second passage hole 13, that is, near the in-plane inflow and outflow ports in the first heat transfer plate 1.

Further, the side fins 23 are each characterized in having a shape following the circumferential edge of the first passage hole 12 or the second passage hole 13, with a portion of the side fin 23 having a shape following the circumferential edge of the first passage hole 12 or the second passage hole 13 being disposed in alignment with the position of the circumferential edge of the first passage hole 12 or the second passage hole 13.

The side fins 23 each having the shape following the circumferential edge of the first passage hole 12 or the second passage hole 13 are thus provided near the first passage hole 12 and the second passage hole 13 each forming the inflow port or the outflow port of the first fluid. It is thereby possible to provide higher resistance to the passage through which the first fluid is likely to flow from the inflow port to the outflow port than the resistance provided in Embodiment 4. It is therefore possible to further improve the in-plane distribution of the heat transfer plates and increase the effective heat transfer area of the header portions of the heat transfer plates, while maintaining the effects of Embodiment 5.

Embodiment 7

Embodiment 7 will be described below. Description of parts overlapping those of Embodiments 1 to 6 will be omitted, and parts the same as or corresponding to those of Embodiments 1 to 6 will be assigned with the same reference signs.

Figure 9:
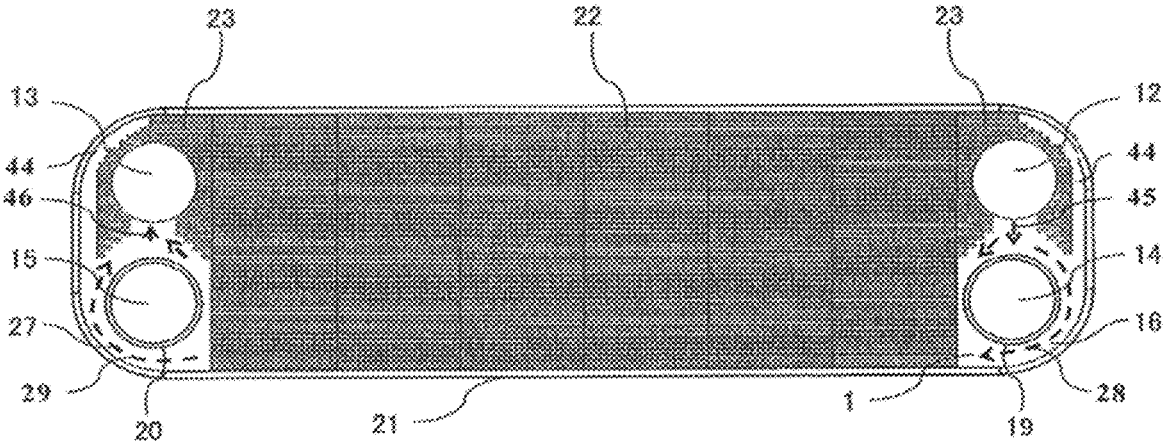
FIG. 9 is a front view illustrating a state in which a first heat transfer plate and an inner fin of a plate heat exchanger according to Embodiment 7 of the present invention are stacked in layers.

FIG. 9 is a front view illustrating a state in which the first heat transfer plate 1 and an inner fin of a plate heat exchanger according to Embodiment 7 of the present invention are stacked in layers.

FIG. 9 is a diagram illustrating the first heat transfer plate 1 and the inner fin stacked in layers, and a description will be given based on the diagram. The second heat transfer plate 2 and the inner fin stacked in layers also have a substantially similar configuration, and thus description and illustration thereof will be omitted.

In Embodiment 7, the inner fin is formed of the central fin 22 and the side fins 23, which are integrated together. The central fin 22 is provided with a shape similar to the shape of the inner fin 11 according to Embodiments 1 and 2, and is disposed at a position similar to the position of the inner fin 11 according to Embodiments 1 and 2. The side fins 23 are provided to parts of the outsides of the opposite side portions of the rectangular central fin 22 in the horizontal direction, and are disposed near the first passage hole 12 and the second passage hole 13, that is, near the in-plane inflow and outflow ports in the first heat transfer plate 1.

Further, the side fins 23 are each characterized in having a shape following a half or more of the circumferential edge of the first passage hole 12 or the second passage hole 13, with a portion of the side fin 23 having a shape following the circumferential edge of the first passage hole 12 or the second passage hole 13 being disposed in alignment with the position of the circumferential edge of the first passage hole 12 or the second passage hole 13.

Further, the side fins 23 are characterized in forming an outflow port 45 and a merging port 46 between the first passage hole 12 and the first adjacent hole 14 and between the second passage hole 13 and the second adjacent hole 15, respectively, and forming small passages 44 between the side fins 23 and the outer wall 21.

The side fins 23 each having the shape following the circumferential edge of the first passage hole 12 or the second passage hole 13 are thus provided near the first passage hole 12 and the second passage hole 13 each forming the inflow port or the outflow port of the first fluid. Further, the outflow port 45 and the merging port 46 are formed between the first passage hole 12 and the first adjacent hole 14 and between the second passage hole 13 and the second adjacent hole 15, respectively, and the small passages 44 are formed between the side fins 23 and the outer wall 21.

It is thereby possible to provide higher resistance to the passage through which the first fluid is likely to flow from the inflow port to the outflow port than the resistance provided in Embodiment 5. It is therefore possible to further increase the effective heat transfer area of the header portions of the heat transfer plates and increase the strength of the heat exchanger, while maintaining the effects of Embodiment 6.

Embodiment 8

Embodiment 8 will be described below. Description of parts overlapping those of Embodiments 1 to 7 will be omitted, and parts the same as or corresponding to those of Embodiments 1 to 7 will be assigned with the same reference signs.

FIG. 10 is a front view illustrating a state in which the first heat transfer plate 1 and an inner fin of a plate heat exchanger according to Embodiment 8 of the present invention are stacked in layers.

FIG. 10 is a diagram illustrating the first heat transfer plate 1 and the inner fin stacked in layers, and a description will be given based on the diagram. The second heat transfer plate 2 and the inner fin stacked in layers also have a substantially similar configuration, and thus description and illustration thereof will be omitted.

In Embodiment 8, the inner fin is formed of the central fin 22, the side fins 23, and side fins 47, which are integrated together. The central fin 22 is provided with a shape similar to the shape of the inner fin 11 according to Embodiments 1 and 2, and is disposed at a position similar to the position of the inner fin 11 according to Embodiments 1 and 2. The side fins 23 are provided to parts of the outsides of the opposite side portions of the rectangular central fin 22 in the horizontal direction, and are disposed near the first passage hole 12 and the second passage hole 13, that is, near the in-plane inflow and outflow ports in the first heat transfer plate 1.

Further, the side fins 23 are each characterized in having a shape following a half or more of the circumferential edge of the first passage hole 12 or the second passage hole 13, with a portion of the side fin 23 having a shape following the circumferential edge of the first passage hole 12 or the second passage hole 13 being disposed in alignment with the position of the circumferential edge of the first passage hole 12 or the second passage hole 13.

Further, the side fins 23 are characterized in forming the outflow port 45 and the merging port 46 between the first passage hole 12 and the first adjacent hole 14 and between the second passage hole 13 and the second adjacent hole 15, respectively, and forming the small passages 44 between the side fins 23 and the outer wall 21.

Further, the side fins 47 are each characterized in being disposed at an exit portion of the bypass passage 28 or an entrance portion of the merging passage 29, forming a passage with a gap between the side fin 47 and the circumferential wall 17 of the first adjacent hole 14 or between the side fin 47 and the circumferential wall 18 of the second adjacent hole 15.

The side fins 23 each having the shape following the circumferential edge of the first passage hole 12 or the second passage hole 13 are thus provided near the first passage hole 12 and the second passage hole 13 each forming the inflow port or the outflow port of the first fluid. Further, the outflow port 45 and the merging port 46 are formed between the first passage hole 12 and the first adjacent hole 14 and between the second passage hole 13 and the second adjacent hole 15, respectively, and the small passages 44 are formed between the side fins 23 and the outer wall 21.

Further, each of the side fins 47 is provided at the exit portion of the bypass passage 28 or the entrance portion of the merging passage 29, forming a passage between the side fin 47 and the circumferential wall 17 of the first adjacent hole 14 or between the side fin 47 and the circumferential wall 18 of the second adjacent hole 15. It is thereby possible to provide higher resistance to the passage through which the first fluid is likely to flow from the inflow port to the outflow port than the resistance provided in Embodiment 6. It is therefore possible to further increase the effective heat transfer area of the header portions of the heat transfer plates and increase the strength of the heat exchanger, while maintaining the effects of Embodiment 7.

Embodiment 9

Embodiment 9 will be described below. Description of parts overlapping those of Embodiments 1 to 8 will be omitted, and parts the same as or corresponding to those of Embodiments 1 to 8 will be assigned with the same reference signs.

Figure 11A:
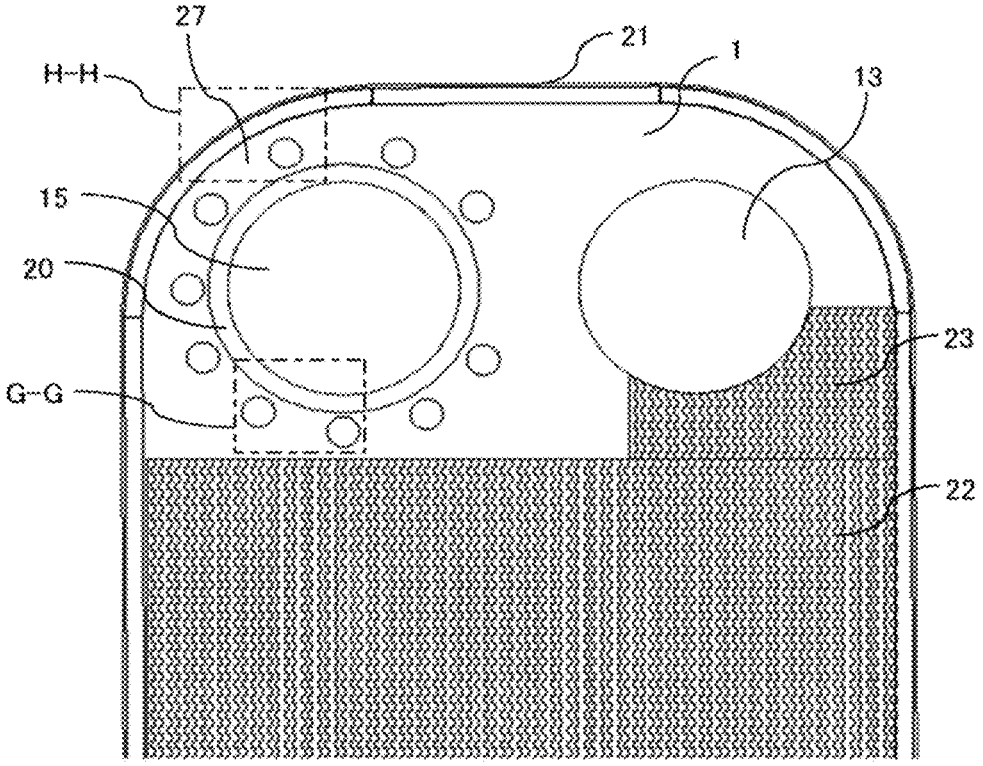
FIG. 11A is an enlarged front view illustrating a periphery of a header portion of a heat transfer plate of a plate heat exchanger according to Embodiment 9 of the present invention.
Figure 11B:
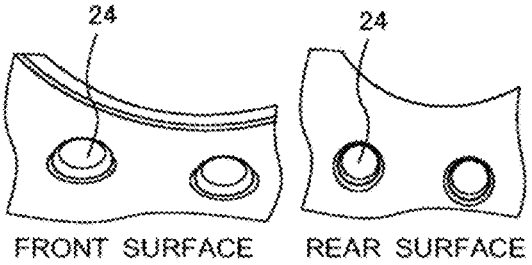
FIG. 11B includes an enlarged front view and an enlarged rear view of a portion taken along line G-G in FIG. 11A.
Figure 11C:
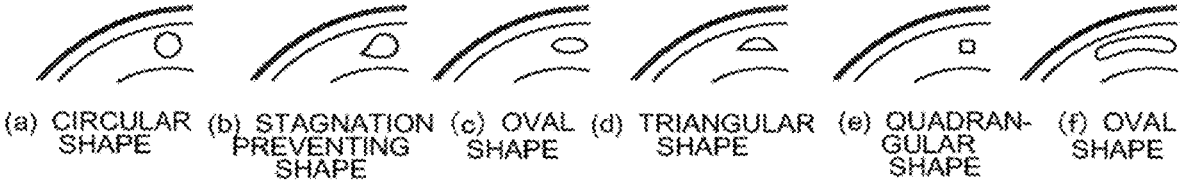
FIG. 11C includes enlarged front views of a portion taken along line H-H in FIG. 11A.

FIG. 11A is an enlarged front view illustrating a periphery of a header portion of a heat transfer plate of a plate heat exchanger according to Embodiment 9 of the present invention. FIG. 11B includes an enlarged front view and an enlarged rear view of a portion taken along line G-G in FIG. 11A. FIG. 11C includes enlarged front views of a portion taken along line H-H in FIG. 11A.

FIG. 11A illustrates an enlarged view of a periphery of a header portion of the first heat transfer plate 1. A periphery of a header portion of the second heat transfer plate 2 also has a substantially similar configuration, and thus description and illustration thereof will be omitted.

In Embodiment 9, projections 24 projecting toward the front surface side from the rear surface side are provided around the adjacent holes of the heat transfer plates. Specifically, the plurality of projections 24 are provided along the circumferential direction outside the flanges 19 and 20 provided to the circumferential walls 17 and 18 of the first adjacent hole 14 and the second adjacent hole 15.

The projections 24 are provided with a height substantially corresponding to the thickness of the inner fin 11, and thus are superimposed on the rear surface of the adjacent heat transfer plate and joined thereto by brazing during the assembly of the plate heat exchanger. Accordingly, it is possible to make a brazed area, that is, a joined area, larger than that in Embodiments 1 to 8, and thus to further increase the pressure resisting strength. Further, processing of the projections 24 increases the heat transfer area, therefore enabling further improvement of overall heat transfer performance of the plate heat exchanger.

The shape of each of the projections 24 is not limited to the shape illustrated in FIG. 11B. As illustrated in (a) to (f)

of FIG. 11C, in a front view of the projection 24, the projection 24 may have a shape such as a circular shape, a stagnation preventing shape that prevents a stagnation area from being formed in a wake, an oval shape, a triangular shape, a quadrangular shape, or a circular arc shape, or a plurality of shapes selected therefrom may be combined to provide the projection 24. Further, the size of the projection 24 is greater than four times the height between the heat transfer plates, and the interval between adjacent ones of the projections 24 is greater than the size of the projection 24.

Further, the layout of the projections 24 provided around the adjacent holes in the heat transfer plates is not limited to the diameter, number, and pitch illustrated in FIG. 11A, and may be different therefrom. To facilitate the assembly process, the layout of the projections 24 is adjusted in half the area of the header having an adjacent hole. Herein, an aim of providing the projections 24 is to increase the strength of the header. Providing the projections 24, however, may adversely affect the in-plane distribution of fluid, and thus it is desirable to reduce the number of projections 24. Therefore, the layout of the projections 24 including the pitch and position thereof is adjusted, and the number of the projections 24 is also adjusted to improve the in-plane distribution of the heat transfer plates while maintaining the strength of the headers.

Embodiment 10

Embodiment 10 will be described below. Description of parts overlapping those of Embodiments 1 to 9 will be omitted, and parts the same as or corresponding to those of Embodiments 1 to 9 will be assigned with the same reference signs.

Figure 12A:
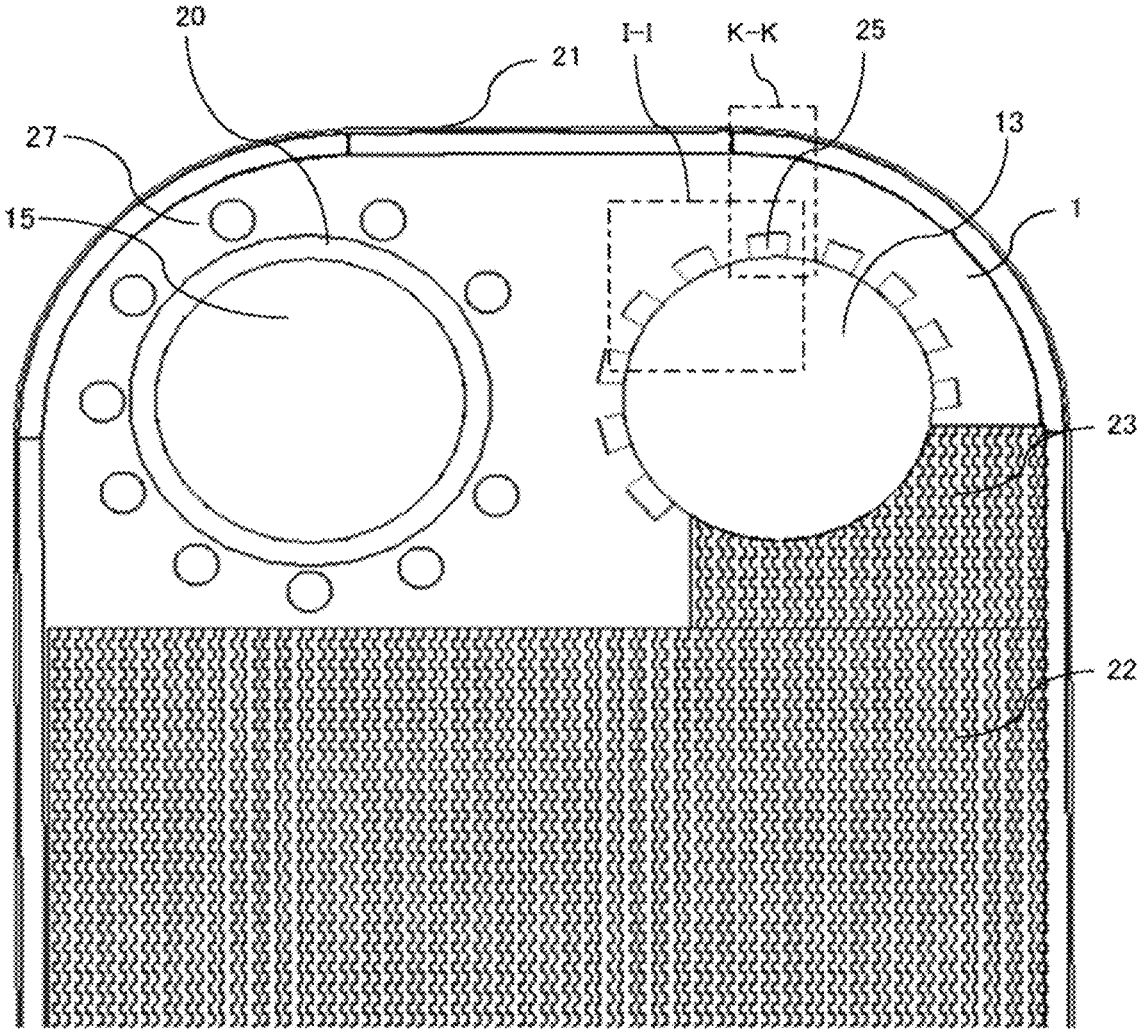
FIG. 12A is an enlarged front view illustrating a periphery of a header portion of a heat transfer plate of a plate heat exchanger according to Embodiment 10 of the present invention.
Figure 12B:
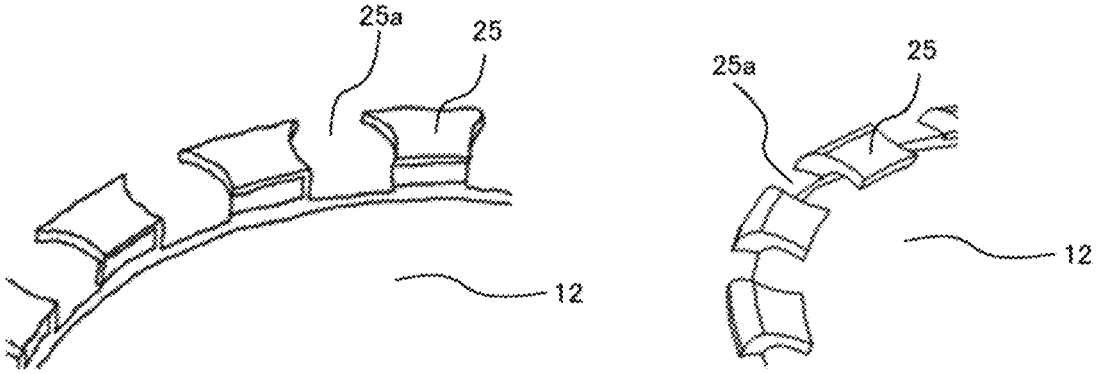
FIG. 12B includes an enlarged perspective view of a portion taken along line I-I in FIG. 12A.
Figure 12C:
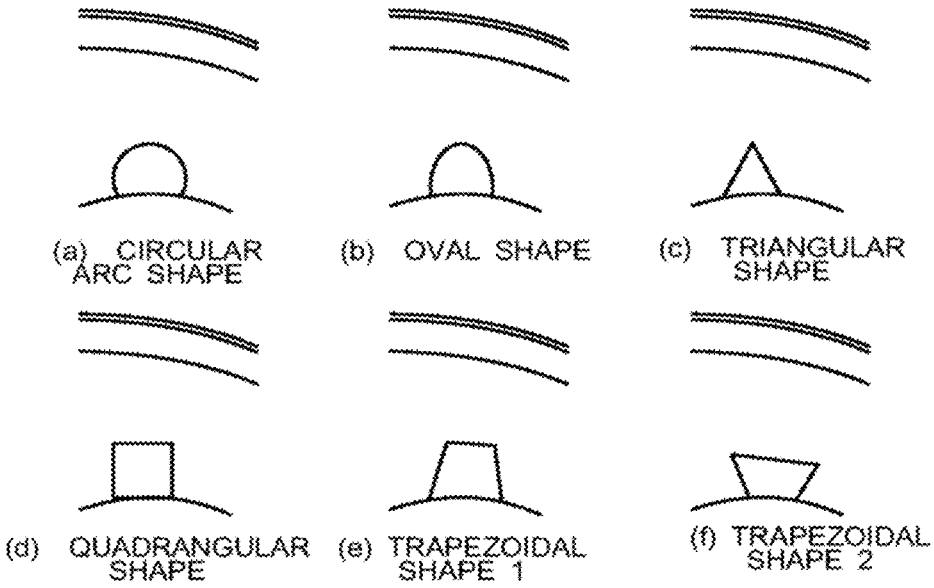
FIG. 12C includes enlarged front views of a portion taken along line K-K in FIG. 12A.

FIG. 12A is an enlarged front view illustrating a periphery of a header portion of a heat transfer plate of a plate heat exchanger according to Embodiment 10 of the present invention. FIG. 12B includes an enlarged front view and an enlarged perspective view of a portion taken along line I-I in FIG. 12A. FIG. 12C includes enlarged front views of a portion taken along line K-K in FIG. 12A.

FIG. 12A illustrates an enlarged view of a periphery of a header portion of the first heat transfer plate 1. A periphery of a header portion of the second heat transfer plate 2 also has a substantially similar configuration, and thus description and illustration thereof will be omitted.

In Embodiment 10, slit portions 25 are provided on the front surface side of the first heat transfer plate 1 around the passage holes in the first heat transfer plate 1 to form slits. Specifically, as illustrated in Example 1 of FIG. 12B, the slit portions 25 are provided to project from the circumferential edges 12*a* and 13*a* of the first passage hole 12 and the second passage hole 13 toward the front surface side and then toward the outside of the first passage hole 12 and the second passage hole 13. Alternatively, as illustrated in Example 2 of FIG. 12B, the slit portions 25 are provided from the outside of the circumferential edges 12*a* and 13*a* of the first passage hole 12 and the second passage hole 13 toward the inside thereof, that is, toward the inside of the first passage hole 12 and the second passage hole 13. With the plurality of slit portions 25 provided along the circumferential direction, a slit 25*a* is formed between adjacent ones of the slit portions 25.

The slit portions 25 are provided with a height substantially corresponding to the thickness of the inner fin 11, and thus are superimposed on the rear surface of the adjacent heat transfer plate and joined thereto by brazing during the assembly of the plate heat exchanger. Accordingly, it is possible to make the brazed area, that is, the joined area, larger than those in Embodiments 1 to 9, and thus to further increase the pressure resisting strength. Further, processing of the slit portions 25 increases the heat transfer area, therefore enabling further improvement of the overall heat transfer performance of the plate heat exchanger.

The shape of each of the slit portions 25 is not limited to the shape illustrated in FIG. 12B. As illustrated in (a) to (f) of FIG. 12C, in a front view of the slit portion 25, the slit portion 25 may have a shape such as a circular arc shape, an oval shape, a triangular shape, a quadrangular shape, or a trapezoidal shape, or a plurality of shapes selected therefrom may be combined to provide the slit portion 25.

Further, the layout of the slit portions 25 provided around the passage holes of the heat transfer holes is not limited to the diameter, number, and pitch, that is, the width of the slit 25*a*, illustrated in FIG. 12A, and may be different therefrom. The widths of the slits 25*a* are not necessarily equal, and may be unequal. The standard of the distribution of the widths of the unequal slits 25*a* is improvement of the in-plane distribution of the heat transfer plates while maintaining the strength of the heat transfer plates.

Embodiment 11

Embodiment 11 will be described below. Description of parts overlapping those of Embodiments 1 to 10 will be omitted, and parts the same as or corresponding to those of Embodiments 1 to 10 will be assigned with the same reference signs.

Figure 13A:
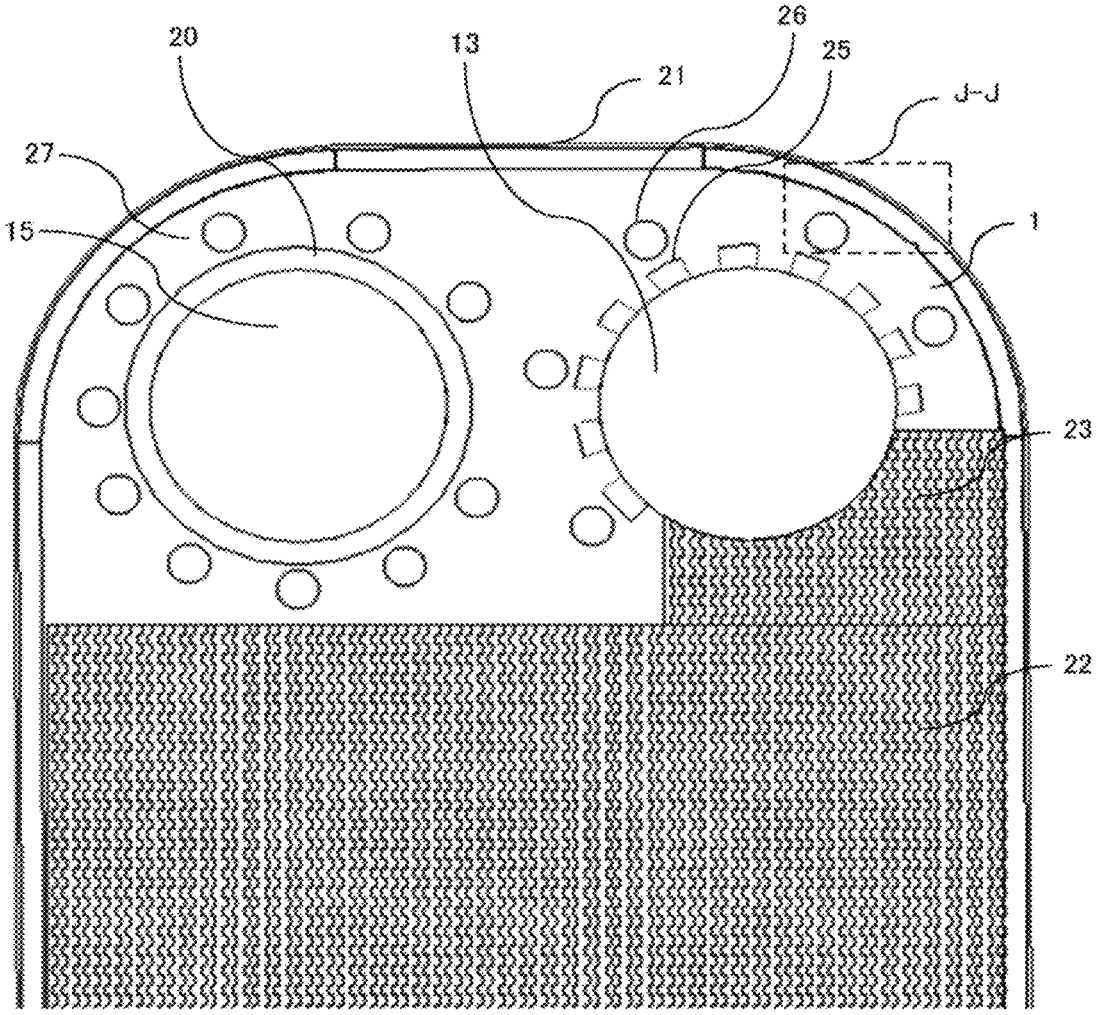
FIG. 13A is an enlarged front view illustrating a periphery of a header portion of a heat transfer plate of a plate heat exchanger according to Embodiment 11 of the present invention.
Figure 13B:
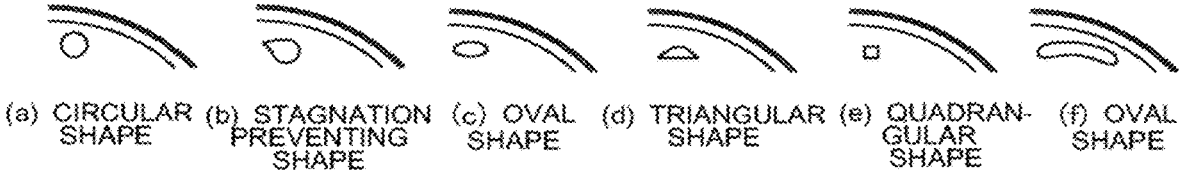
FIG. 13B includes enlarged front views of a portion taken along line J-J in FIG. 13A.

FIG. 13A is an enlarged front view illustrating a periphery of a header portion of a heat transfer plate of a plate heat exchanger according to Embodiment 11 of the present invention. FIG. 13B includes enlarged front views of a portion taken along line J-J in FIG. 13A.

FIG. 13A illustrates an enlarged view of a periphery of a header portion of the first heat transfer plate 1. A periphery of a header portion of the second heat transfer plate 2 also has a substantially similar configuration, and thus description and illustration thereof will be omitted.

In Embodiment 11, the slit portions 25 are provided on the front surface side of the heat transfer plates around the passage holes of the heat transfer plates, and projections 26 projecting toward the front surface side from the rear surface side are provided around the slit portions 25. Specifically, the plurality of slit portions 25 are provided along the circumferential direction outside the flanges 19 and 20 provided to the circumferential walls 17 and 18 of the first adjacent hole 14 and the second adjacent hole 15, and the plurality of projections 26 are provided along the circumferential direction outside the slit portions 25.

The projections 26 are provided with a height substantially corresponding to the thickness of the inner fin 11, and thus are superimposed on the rear surface of the adjacent heat transfer plate and joined thereto by brazing during the assembly of the plate heat exchanger. Accordingly, it is possible to make the brazed area, that is, the joined area, larger than those in Embodiments 1 to 10, and thus to further increase the pressure resisting strength. Further, processing of the projections 26 increases the heat transfer area, therefore enabling further improvement of the overall heat transfer performance of the plate heat exchanger.

The shape of each of the projections 26 is not limited to the shape illustrated in FIG. 13A. As illustrated in (a) to (f) of FIG. 13B, in a front view of the projection 26, the projection 26 may have a shape such as a circular shape, a stagnation preventing shape, an oval shape, a triangular shape, a quadrangular shape, or a circular arc shape, or a plurality of shapes selected therefrom may be combined to provide the projection 26. Further, the size of the projection 26 is greater than four times the height between the heat transfer plates, and the interval between adjacent ones of the projections 26 is greater than the size of the projection 26.

Further, the layout of the projections 26 provided around the adjacent holes of the heat transfer holes is not limited to the diameter, number, and pitch illustrated in FIG. 13A, and may be different therefrom. To facilitate the assembly process, the layout of the projections 26 is adjusted in half the area of the header having an adjacent hole. The standard of the adjustment is improvement of the in-plane distribution of the heat transfer plates while maintaining the strength of the heat transfer plates.

Embodiment 12

Embodiment 12 will be described below. Description of parts overlapping those of Embodiments 1 to 11 will be omitted, and parts the same as or corresponding to those of Embodiments 1 to 11 will be assigned with the same reference signs.

In Embodiment 12, a description will be given of a heat pump heating and hot water supply system as an example of application of the inner fin plate heat exchanger described in one of Embodiments 1 to 11.

Figure 14:
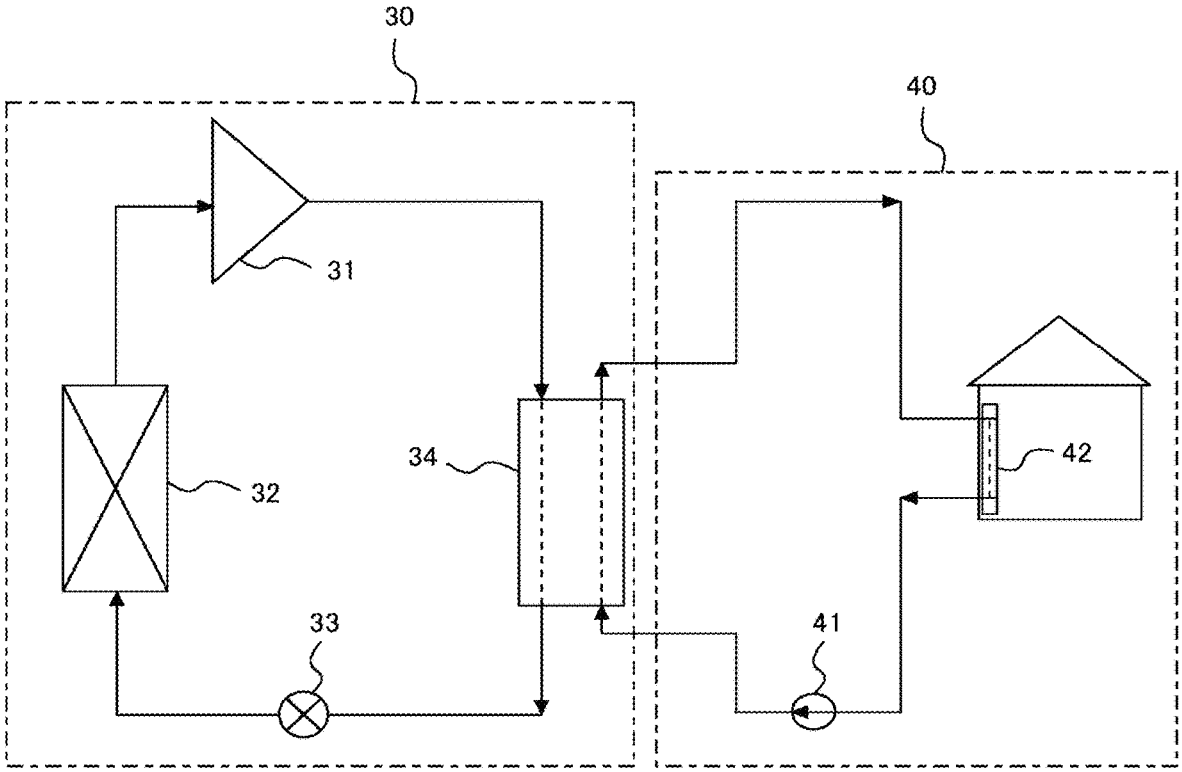
FIG. 14 is a schematic diagram illustrating a configuration of a heat pump heating and hot water supply system according to Embodiment 12 of the present invention.

FIG. 14 is a schematic diagram illustrating a configuration of the heat pump heating and hot water supply system according to Embodiment 12 of the present invention.

The heat pump heating and hot water supply system includes a main refrigerant circuit 30 sequentially connecting a compressor 31, a heat exchanger 32, an expansion valve 33, and a heat exchanger 34 and a water circuit 40 sequentially connecting the heat exchanger 34, a heating and hot water supply water using apparatus 42, and a heating and hot water supply water pump 41.

Herein, the heat exchanger 34 is the inner fin plate heat exchanger described in one of Embodiments 1 to 11 described above. Further, the compressor 31, the heat exchanger 32, the expansion valve 33, the heat exchanger 34, and the main refrigerant circuit 30 sequentially connecting these apparatuses are stored in a unit, which will be referred to as a heat pump apparatus.

As described in Embodiments 1 to 11 described above, the inner fin plate heat exchanger has high heat exchange efficiency and high reliability. Therefore, the inner fin plate heat exchanger mounted in the heat pump heating and hot water supply system described in Embodiment 12 achieves an efficient heat pump heating and hot water supply system capable of suppressing power consumption and reducing the amount of $CO_2$ emission.

The above description has been given of the heat pump heating and hot water supply system that exchanges heat between the refrigerant and water with the inner fin plate heat exchanger described in one of Embodiments 1 to 11 described above. However, the inner fin plate heat exchangers described in Embodiments 1 to 11 described above are not limited thereto, and are applicable to many industrial and domestic apparatuses such as apparatuses related to power generation and a thermal food sterilization process, including a cooling chiller.

As an application example of the present invention, it is possible to employ the present invention in a heat pump apparatus required to be easily manufactured and be improved in heat exchange performance and energy saving performance.

REFERENCE SIGN LIST

1 first heat transfer plate 2 second heat transfer plate 3 first reinforcing side plate 4 second reinforcing side plate 5 first inflow pipe 6 second inflow pipe 7 first outflow pipe 8 second outflow pipe 9 first micro-channel passage 10 second micro-channel passage 11 inner fin 11*a* heat transfer surface 12 first passage hole 12*a* circumferential edge 13 second passage hole 13*a* circumferential edge 14 first adjacent hole 14*a* circumferential edge 15 second adjacent hole 15*a* circumferential edge 16 first header portion 17 circumferential wall 18 circumferential wall 19 flange 20 flange 21 outer wall 22 central fin 23 side fin 24 projection 25 slit portion 25*a* slit 26 projection 27 second header portion 28 bypass passage 29 merging passage 30 main refrigerant circuit 31 compressor 32 heat exchanger 33 expansion valve 34 heat exchanger 40 water circuit 41 heating and hot water supply water pump 42 heating and hot water supply water using apparatus 43 main passage 44 small passage 45 outflow port 46 merging port 47 side fin 100 plate heat exchanger

The invention claimed is:

1. A plate heat exchanger comprising:

first heat transfer plates, each of the first heat transfer plates having a rectangular plate shape, and having a passage hole formed in one side portion thereof in a horizontal direction in a front view thereof to form an inflow port of first fluid, a passage hole formed in an other side portion thereof in the horizontal direction in the front view to form an outflow port of the first fluid, an adjacent hole formed in the one side portion or the other side portion to form an inflow port of second fluid, and an adjacent hole formed in the side portion opposite to the side portion formed with the adjacent hole for the second fluid to form an outflow port of the second fluid; and second heat transfer plates, each of the second heat transfer plates having a rectangular plate shape, and having an adjacent hole formed in one side portion thereof in a horizontal direction in a front view thereof to form the inflow port of the first fluid, an adjacent hole formed in an other side portion thereof in the horizontal direction in the front view to form the outflow port of the first fluid, a passage hole formed in the one side portion or the other side portion to form the inflow port of the second fluid, and a passage hole formed in the side portion opposite to the side portion formed with the passage hole for the second fluid to form the outflow port of the second fluid, wherein the first heat transfer plates and the second heat transfer plates are alternately stacked in a plurality of layers to alternately form first passages and second passages in a stacking direction between the first heat transfer plates and the second heat transfer plates, with the first passages allowing the first fluid to flow therethrough from the inflow port of the first fluid to the outflow port of the first fluid in the horizontal direction in the front view, and the second passages allowing the second fluid to flow therethrough from the inflow port of the second fluid to the outflow port of the second fluid in the horizontal direction in the front view, to exchange heat between the first fluid flowing through the first passages and the second fluid flowing through the second passages, wherein each of the first heat transfer plates and a corresponding one of the second heat transfer plates have an inner fin therebetween, or each of the first heat transfer plates and the second heat transfer plates has a corrugated heat transfer surface, wherein each of the adjacent holes is provided with a circumferential wall in a thickness direction around a circumferential edge thereof, and the circumferential wall is provided with a flange on a front surface side thereof, wherein the flange provided to each of the first heat transfer plates and the second heat transfer plates is joined to a rear surface of one of the first heat transfer plates and the second heat transfer plates adjacent to each of the first heat transfer plates and the second heat transfer plates, wherein a bypass passage and a main passage are formed upstream of the first passages and the second passages between adjacent ones of the first heat transfer plates and the second heat transfer plates, with the bypass passage allowing the first fluid flowing from the inflow port of the first fluid or the second fluid flowing from the inflow port of the second fluid to pass a side farther than a corresponding one of the adjacent holes while spreading in a vertical direction in the front view and then flow into the inner fin or the corrugated heat transfer surface, and the main passage allowing the first fluid flowing from the inflow port of the first fluid or the second fluid flowing from the inflow port of the second fluid to directly flow toward the inner fin or the corrugated heat transfer surface without routing through the bypass passage, wherein a flat space is formed around an entire circumference of each of the adjacent holes, and the first fluid or the second fluid flowing through the main passage and the first fluid or the second fluid flowing through the bypass passage merge in the space between the circumferential wall and the inner fin or the corrugated heat transfer surface, and wherein a distance between the inner fin or the corrugated heat transfer surface and each of the passage holes is shorter than a distance between the inner fin or the corrugated heat transfer surface and each of the adjacent holes.

2. The plate heat exchanger of claim 1, wherein a gap between the circumferential wall of each of the adjacent holes and the inner fin or the corrugated heat transfer surface has a length equal to or greater than three times a height of the circumferential wall.

3. The plate heat exchanger of claim 1, wherein the flange is provided toward outside of the circumferential wall.

4. The plate heat exchanger of claim 1, wherein the flange is provided toward inside of the circumferential wall.

5. The plate heat exchanger of claim 1, wherein a rear surface of each of the first heat transfer plates and the flange of a corresponding one of the second heat transfer plates are joined together, and a rear surface of each of the second heat transfer plates and the flange of a corresponding one of the first heat transfer plates are joined together.

6. The plate heat exchanger of claim 1, wherein a merging passage is formed downstream of the first passages and the second passages between adjacent ones of the first heat transfer plates and the second heat transfer plates to merge flows of the first fluid flowing through the first passages or flows of the second fluid flowing through the second passages.

7. The plate heat exchanger of claim 1, wherein each of the first heat transfer plates and the second heat transfer plates is provided with a plurality of projections projecting from a rear surface side thereof toward a front surface side thereof around each of the adjacent holes.

8. The plate heat exchanger of claim 1, wherein each of the first heat transfer plates and the second heat transfer plates is provided with a plurality of projections projecting from a rear surface side thereof toward a front surface side thereof around each of the passage holes.

9. The plate heat exchanger of claim 7, wherein in a front view of each of the plurality of projections, each of the plurality of projections has one of a circular shape, a stagnation preventing shape, an oval shape, a triangular shape, a quadrangular shape, and a circular arc shape or a combination of a plurality of shapes selected therefrom.

10. The plate heat exchanger of claim 1, wherein a plurality of slit portions are provided around a circumferential edge of each of the passage holes to form a slit between adjacent ones of the plurality of slit portions.

11. The plate heat exchanger of claim 10, wherein the plurality of slit portions are provided to project from the circumferential edge of each of the passage holes toward a front surface side of each of the passage holes and then toward outside of each of the passage holes.

12. The plate heat exchanger of claim 10, wherein the plurality of slit portions are provided from outside of the circumferential edge of each of the passage holes toward inside of each of the passage holes.

13. The plate heat exchanger of claim 10, wherein in a front view of each of the plurality of slit portions, each of the plurality of slit portions has one of a circular arc shape, an oval shape, a triangular shape, a quadrangular shape, and a trapezoidal shape or a combination of a plurality of shapes selected therefrom.

14. The plate heat exchanger of claim 1, wherein the inner fin is of one of an offset type, a flat plate fin type, an undulated fin type, a louver type, and a corrugated fin type or a combination of a plurality of types selected therefrom.

15. The plate heat exchanger of claim 1, wherein each of the first heat transfer plates and the second heat transfer plates has an outer wall projecting in a thickness direction around an outer circumference thereof, wherein the outer wall is provided to be tilted outward with respect to the thickness direction, and wherein an area of contact between an inside of the outer wall of one of the first heat transfer plates and the second heat transfer plates and an outside of the outer wall of another one of the first heat transfer plates and the second heat transfer plates adjacent to the one of the first heat transfer plates and the second heat transfer plates are joined together.

16. The plate heat exchanger of claim 1, wherein the inner fin has a shape following the circumferential edge of each of the passage holes, and wherein a portion of the inner fin having a shape following the circumferential edge of each of the passage holes is disposed in alignment with a position of the circumferential edge of each of the passage holes.

17. A heat pump heating and hot water supply system comprising:

a main refrigerant circuit sequentially connecting a compressor, a heat exchanger, an expansion valve, and the plate heat exchanger of claim 1; and a water circuit sequentially connecting the plate heat exchanger, a heating and hot water supply water using apparatus, and a heating and hot water supply water pump.

18. A plate heat exchanger comprising:

first heat transfer plates, each of the first heat transfer plates having a rectangular plate shape, and having a passage hole formed in one side portion thereof in a horizontal direction in a front view thereof to form an inflow port of first fluid, a passage hole formed in an other side portion thereof in the horizontal direction in the front view to form an outflow port of the first fluid, an adjacent hole formed in the one side portion or the other side portion to form an inflow port of second fluid, and an adjacent hole formed in the side portion opposite to the side portion formed with the adjacent hole for the second fluid to form an outflow port of the second fluid; and second heat transfer plates, each of the second heat transfer plates having a rectangular plate shape, and having an adjacent hole formed in one side portion thereof in a horizontal direction in a front view thereof to form the inflow port of the first fluid, an adjacent hole formed in an other side portion thereof in the horizontal direction in the front view to form the outflow port of the first fluid, a passage hole formed in the one side portion or the other side portion to form the inflow port of the second fluid, and a passage hole formed in the side portion opposite to the side portion formed with the passage hole for the second fluid to form the outflow port of the second fluid, wherein the first heat transfer plates and the second heat transfer plates are alternately stacked in a plurality of layers to alternately form first passages and second passages in a stacking direction between the first heat transfer plates and the second heat transfer plates, with the first passages allowing the first fluid to flow therethrough from the inflow port of the first fluid to the outflow port of the first fluid in the horizontal direction in the front view, and the second passages allowing the second fluid to flow therethrough from the inflow port of the second fluid to the outflow port of the second fluid in the horizontal direction in the front view, to exchange heat between the first fluid flowing through the first passages and the second fluid flowing through the second passages, wherein each of the first heat transfer plates and a corresponding one of the second heat transfer plates have an inner fin therebetween, or each of the first heat transfer plates and the second heat transfer plates has a corrugated heat transfer surface, wherein each of the adjacent holes is provided with a circumferential wall in a thickness direction around a circumferential edge thereof, and the circumferential wall is provided with a flange on a front surface side thereof, wherein the flange provided to each of the first heat transfer plates and the second heat transfer plates is joined to a rear surface of one of the first heat transfer plates and the second heat transfer plates adjacent to each of the first heat transfer plates and the second heat transfer plates, wherein a bypass passage and a main passage are formed upstream of the first passages and the second passages between adjacent ones of the first heat transfer plates and the second heat transfer plates, with the bypass passage allowing the first fluid flowing from the inflow port of the first fluid or the second fluid flowing from the inflow port of the second fluid to pass a side farther than a corresponding one of the adjacent holes while spreading in a vertical direction in the front view and then flow into the inner fin or the corrugated heat transfer surface, and the main passage allowing the first fluid flowing from the inflow port of the first fluid or the second fluid flowing from the inflow port of the second fluid to directly flow toward the inner fin or the corrugated heat transfer surface without routing through the bypass passage, wherein a flat space is formed around an entire circumference of each of the adjacent holes, and the first fluid or the second fluid flowing through the main passage and the first fluid or the second fluid flowing through the bypass passage merge in the space between the circumferential wall and the inner fin or the corrugated heat transfer surface, wherein a plurality of slit portions are provided around a circumferential edge of each of the passage holes to form a slit between adjacent ones of the plurality of slit portions, and wherein the plurality of slit portions are provided to project from the circumferential edge of each of the passage holes toward a front surface side of each of the passage holes and then toward outside of each of the passage holes.

19. The plate heat exchanger of claim 18, wherein a distance between the inner fin or the corrugated heat transfer surface and each of the passage holes is shorter than a distance between the inner fin or the corrugated heat transfer surface and each of the adjacent holes.

* * * * *